US008227964B2

(12) United States Patent
Choi et al.

(10) Patent No.: US 8,227,964 B2
(45) Date of Patent: Jul. 24, 2012

(54) LIGHTING DEVICE

(75) Inventors: Tae Young Choi, Seoul (KR); Hwa Young Kim, Seoul (KR); Il Yeong Kang, Seoul (KR); Sang Won Lee, Seoul (KR); Ji Hoo Kim, Seoul (KR); Seung Hyuk Lee, Seoul (KR); Sung Ku Kang, Seoul (KR); Cheon Joo Kim, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 13/153,156

(22) Filed: Jun. 3, 2011

(65) Prior Publication Data

US 2011/0234078 A1 Sep. 29, 2011

(30) Foreign Application Priority Data

Jun. 4, 2010 (KR) ..... 10-2010-0053089

(51) Int. Cl.

| | |
|---|---|
| ***H01J 1/02*** | (2006.01) |
| ***H01J 7/24*** | (2006.01) |
| ***H01J 61/52*** | (2006.01) |
| ***H01K 1/58*** | (2006.01) |

(52) U.S. Cl. ..... 313/46; 313/498; 313/512; 313/113; 313/318.01

(58) Field of Classification Search ..... 313/498, 313/512, 113, 318.01, 318.04, 318.11, 318.12, 313/46

See application file for complete search history.

(56) References Cited

U.S. PATENT DOCUMENTS

| | | | | |
|---|---|---|---|---|
| 2004/0037088 | A1* | 2/2004 | English et al. | 362/545 |
| 2009/0147521 | A1* | 6/2009 | Zhang et al. | 362/294 |
| 2010/0096992 | A1* | 4/2010 | Yamamoto et al. | 315/112 |
| 2010/0165635 | A1* | 7/2010 | Chen et al. | 362/307 |
| 2010/0289396 | A1* | 11/2010 | Osawa et al. | 313/46 |
| 2010/0289407 | A1* | 11/2010 | Anderson et al. | 315/35 |

FOREIGN PATENT DOCUMENTS

| | | |
|---|---|---|
| JP | 09-237612 | 9/1997 |
| JP | 2000-045237 | 2/2000 |
| JP | 2005-286267 | 10/2005 |
| JP | 2006-310057 | 11/2006 |
| JP | 2006-313717 | 11/2006 |
| JP | 2007-227240 | 9/2007 |
| JP | 2008-159453 | 7/2008 |
| JP | 2009-163954 | 7/2009 |
| JP | 2009-170114 | 7/2009 |
| JP | 2010-009981 | 1/2010 |
| KR | 20-0165953 | 10/1999 |

(Continued)

*Primary Examiner* — Toan Ton
*Assistant Examiner* — Kevin Quarterman
(74) *Attorney, Agent, or Firm* — Lowe Hauptman Ham & Berner LLP

(57) ABSTRACT

A lighting device includes a light emitting module, a member disposed on the light emitting module, a cover surrounding the light emitting module and the member, and a heat sink. The light emitting module includes a substrate and a light emitting diode disposed on the substrate. The member includes a base having a hole configured to receive the light emitting diode and a projection configured to reflect light from the light emitting diode. A diameter of the base is greater than a maximum diameter of the projection. The heat sink includes an upper portion having a flat surface on which the substrate is disposed and a lower portion having a plurality of grooves formed on a side surface of the heat sink.

19 Claims, 21 Drawing Sheets

FOREIGN PATENT DOCUMENTS

| | | |
|---|---|---|
| KR | 20-0188613 | 4/2000 |
| KR | 1020040078084 | 9/2004 |
| KR | 1020060126073 | 12/2006 |
| KR | 1020070111830 | 11/2007 |
| KR | 100799518 | 1/2008 |
| KR | 1020080062086 | 7/2008 |
| KR | 20-2009-0001671 | 2/2009 |
| KR | 20-0445445 | 7/2009 |
| KR | 100910633 | 7/2009 |
| KR | 1020090119572 | 11/2009 |
| KR | 100933022 | 12/2009 |
| KR | 1020100033142 | 3/2010 |
| KR | 1020100034127 | 4/2010 |
| KR | 1020100064800 | 6/2010 |
| KR | 1020100066685 | 6/2010 |
| KR | 1020100069095 | 6/2010 |
| KR | 1020100076149 | 7/2010 |
| KR | 1020100086421 | 7/2010 |

* cited by examiner

LIGHTING DEVICE

CROSS REFERENCE TO RELATED APPLICATION

This application claims the priority of Korean Patent Application No. 10-2010-0053089, filed on Jun. 4, 2010, and Korean Patent Application No. 10-2010-0067617, filed on Jul. 13, 2010, and Korean Patent Application No. 10-2010-0090987, filed on Sep. 16, 2010, and Korean Patent Application No. 10-2010-0090989 filed on Sep. 16, 2010, and Korean Patent Application No. 10-2010-0090990, filed on Sep. 16, 2010 in the KIPO (Korean Intellectual Property Office), the disclosure of which are incorporated herein in their entirety by reference.

BACKGROUND

1. Field

This embodiment relates to a lighting device.

2. Description of the Related Art

A light emitting diode (LED) is a semiconductor element for converting electric energy into light. The LED has advantages of low power consumption, a semi-permanent span of life, a rapid response speed, safety and an environment-friendliness. Therefore, many researches are devoted to substitution of conventional light sources with the LED. The LED is now being increasingly used as a light source for lighting devices, for example, various lamps used interiorly and exteriorly, a liquid crystal display device, an electric sign and a street lamp and the like.

SUMMARY

One embodiment is a lighting device. The lighting device includes:

- a light emitting module including a substrate and a light emitting diode disposed on the substrate;
- a member being disposed on the light emitting module and including a hole into which the light emitting diode is inserted and a projection that reflects light from the light emitting diode;
- a cover surrounding the light emitting module and the member; and
- a heat sink including a top surface thereof disposed under the light emitting module and radiating heat from a plurality of the light emitting devices.

Another embodiment is a lighting device. The lighting device includes:

- a light emitting module including a substrate and a light emitting diode disposed on the substrate;
- a cover to which light generated from the light emitting diode is irradiated and including a partial opening; and
- a heat sink being coupled to the cover and radiating heat generated from the light emitting diode,
  - wherein the heat sink includes an upper portion of which the top surface is at least partly flat and a lower portion having heat radiating fins formed therein,
  - wherein the top surface of the heat sink includes at least any one of a groove, a hole and/or a projection,
  - wherein the light emitting module is coupled to the at least any one of the groove, the hole and/or the projection of the top surface of the heat sink, and
  - wherein a guide is disposed on at least one of the top surface of the heat sink and the substrate of the light emitting module such that the light emitting module is arranged on the top surface of the heat sink in a certain direction.

DETAILED DESCRIPTION OF THE EMBODIMENTS

A thickness or size of each layer is magnified, omitted or schematically shown for the purpose of convenience and clearness of description. The size of each component does not necessarily mean its actual size.

It will be understood that when an element is referred to as being 'on' or "under" another element, it can be directly on/under the element, and one or more intervening elements may also be present. When an element is referred to as being 'on' or 'under', 'under the element' as well as 'on the element' can be included based on the element.

Hereinafter, an embodiment of the present invention will be described in detail with reference to the accompanying drawings.

Figure 1:
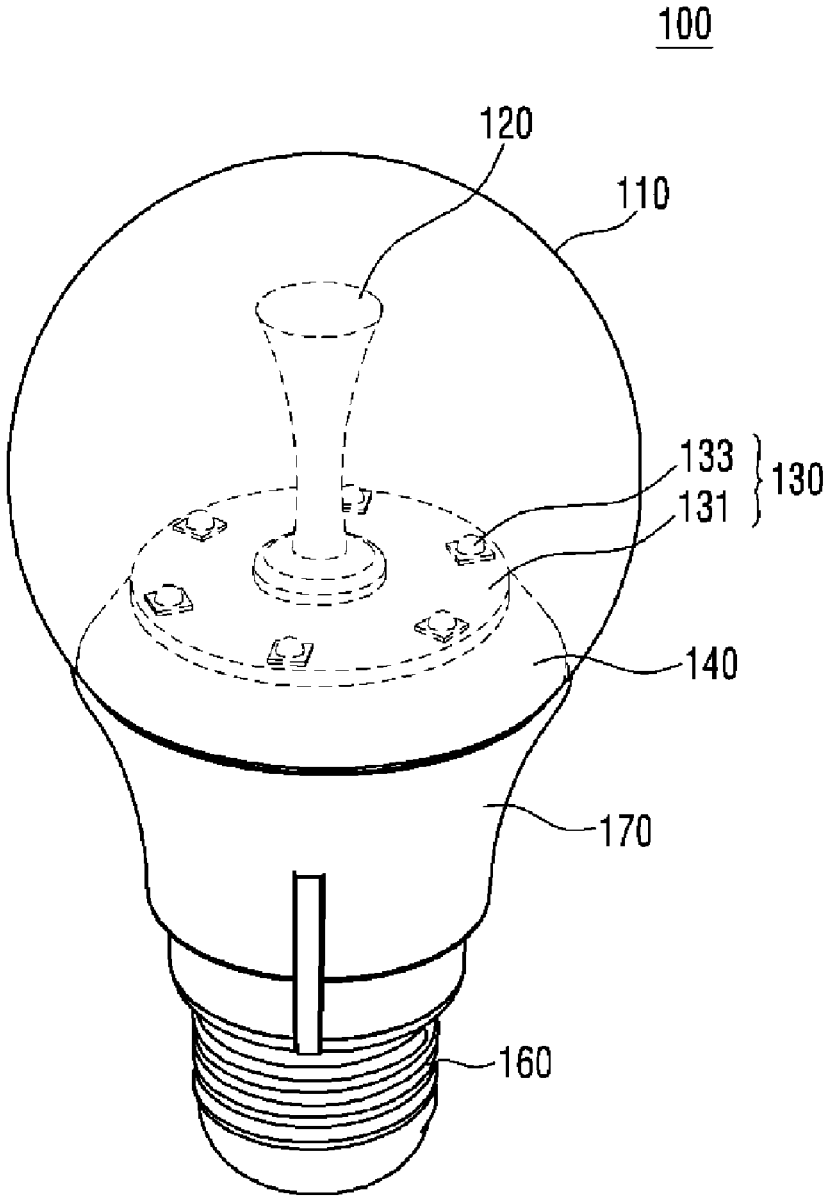
FIG. 1 is a perspective view showing an embodiment of a lighting device according to the present invention.
Figure 2:
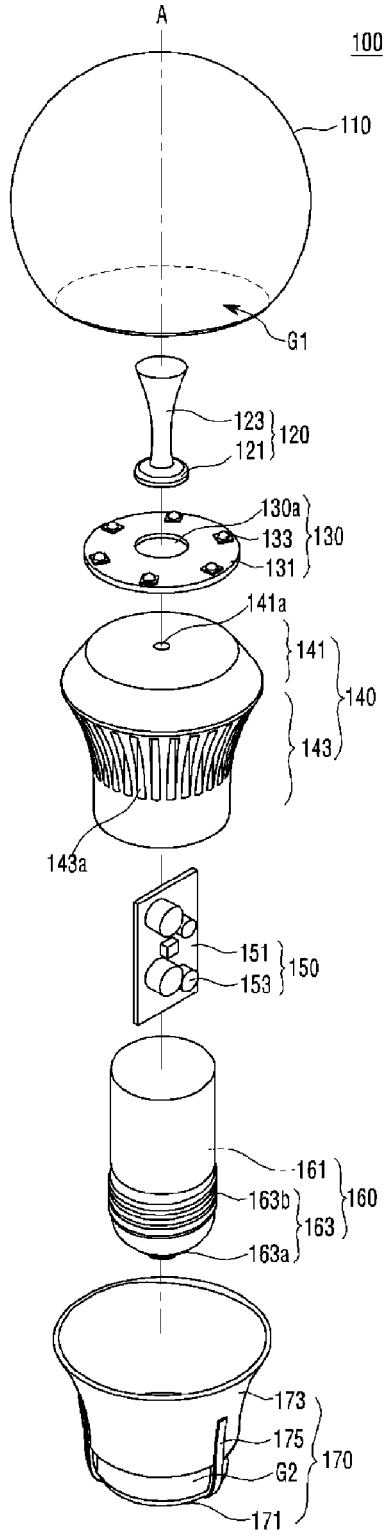
FIG. 2 is an exploded perspective view of the lighting device shown in FIG. 1.
Figure 3:
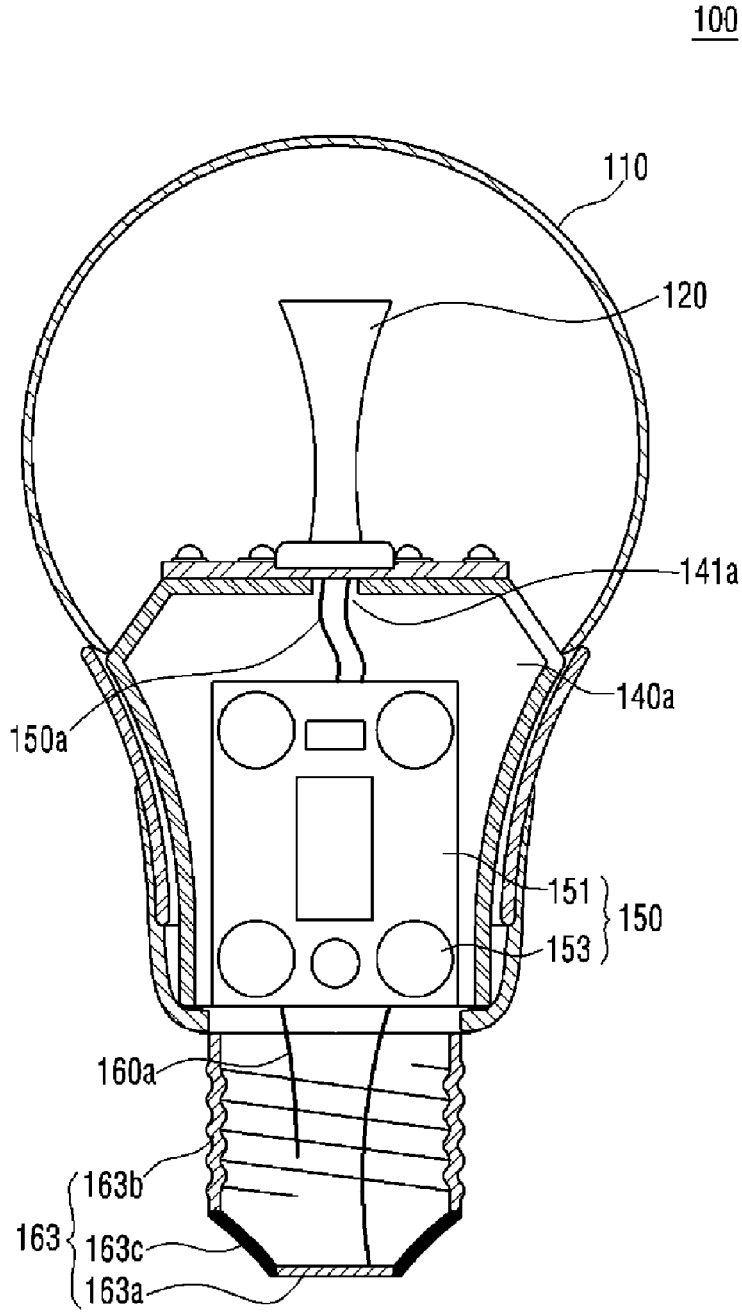
FIG. 3 is a cross sectional view of the lighting device shown in FIG. 1.

FIG. 1 is a perspective view showing an embodiment of a lighting device according to the present invention. FIG. 2 is an exploded perspective view of the lighting device shown in FIG. 1. FIG. 3 is a cross sectional view of the lighting device shown in FIG. 1.

Referring to FIGS. 1 to 3, the lighting device 100 includes a cover 110, a member 120, a light emitting module 130, a heat sink 140, a power controller 150, an inner case 160 and an outer case 170.

The cover 110 surrounds and protects the light emitting module 130 and the member 120 from external impacts. The cover 110 distributes light generated by the light emitting module 130 to the front (top) or to the rear (bottom) of the lighting device 100.

The heat sink 140 radiates heat generated by the light emitting module 130 to the outside at the time of driving the lighting device 100. The heat sink 140 improves the heat radiation efficiency through as much surface contact with the light emitting module 130 as possible.

The outer case 170 surrounds the heat sink 140, the power controller 150 and the inner case 160 and the like and determines the external appearance of the lighting device 100.

Hereafter, the lighting device 100 according to the embodiment will be described in detail focusing on its constituents.

<Cover>

The cover 110 has a bulb shape and an opening 'G1'. The inner surface of the cover 110 is coated with a yellowish pigment. The pigment may include a diffusing agent such that light passing through the cover 110 can be diffused throughout the inner surface of the cover 110.

The cover 110 may be formed of glass. However, the glass is vulnerable to weight or external impact. Therefore, plastic, polypropylene (PP) and polyethylene (PE) and the like can be used as the material of the cover 110. Here, polycarbonate (PC), etc., having excellent light resistance, excellent thermal resistance and excellent impact strength property can be also used as the material of the cover 110.

<Member>

The member 120 includes a base 121 and a cone 123. The base 121 and the cone 123 are integrally formed with each other or are separately formed and mechanically connected together by an adhesive agent.

The base 121 has a circular shape.

The cone 123 extends from one side of the base 121. The diameter of the cone 123 increases along the central axis 'A' of the base 121. The top surface of the cone 123 has a flat circular shape. Such a cone 123 functions as a reflector reflecting light emitted from the light emitting module 130.

While the embodiment shows that the member 120 includes the base 121, the member 120 can be constituted by the cone 123 only without the base 121.

The member 120 is made of a metallic material or a resin material which has a high reflection efficiency. The resin material includes, for example, any one of PET, PC and PVC. The metallic material includes at least any one of Ag, an alloy including Ag, Al, an alloy including Al.

Further, the surface of the member 120 is coated with Ag, Al, white photo solder resist (PSR) ink and a diffusion sheet and the like. Otherwise, an oxide film is formed on the surface of the member 120 by an anodizing process.

However, there is no limit to the material and color of the member 120. The material and color of the member 120 can be variously selected according to a desired lighting of the lighting device 100.

<Light Emitting Module>

The light emitting module 130 includes a substrate 131 and a plurality of light emitting devices 133 mounted on the substrate 131.

The substrate 131 has a circular shape. The central portion of the substrate 131 includes a seating groove 130*a* to which the base 121 of the member 120 is seated and coupled.

The substrate 131 is made by printing circuit patterns on an insulator and includes, for example, a common printed circuit board (PCB), a metal core PCB, a flexible PCB and a ceramic PCB and the like. Here, it is recommended that the substrate 131 include a chips on board (COB) allowing an unpackaged LED chip to be directly bonded thereon. The OCB type substrate includes a ceramic material to obtain insulation and thermal resistance for heat generated by driving the lighting device 100.

Further, the substrate 131 can be made of a material capable of efficiently reflecting light, or the surface of the substrate 131 may have color capable of efficiently reflecting light, for example, white and silver and the like.

The plurality of the light emitting devices 133 are radially arranged on the substrate 131, so that heat generated from the light emitting devices 133 can be efficiently radiated when the lighting device 100 is operated. Each of the plurality of the light emitting devices 133 includes at least one light emitting diode (LED). The LED may be a red, green, blue or white light emitting diode, each of which emits red, green, blue or white light respectively. The kind and number of the diodes are not limited to this.

<Heat Sink>

The heat sink 140 includes a receiving groove 140*a* for receiving the power controller 150 and the inner case 160.

The heat sink 140 also includes a plurality of fins. The heat sink 140 includes an upper portion 141 of which the top surface is at least partly flat and a lower portion 143 having heat radiating fins formed therein.

The heat sink 140 includes an upper portion 141 and a lower portion 143. The upper portion 141 has a cylindrical shape. The cylindrical upper portion 141 includes a circular top surface on which the light emitting module 130 is disposed. The diameter of the top surface increases downward along the central axis 'A' of the top surface. The lower portion 143 has a cylindrical shape. The cylindrical lower portion 143 extends from the cylindrical upper portion 141. The diameter of the cylindrical lower portion 143 decreases downward along the central axis 'A' of the top surface.

The cylindrical upper portion 141 has a hole 141*a* extending through one side of the cylindrical upper portion 141. Here, the hole 141*a* is located in the central portion of the one side of the cylindrical upper portion 141. Such a hole 141*a* functions as a path that allows wiring from the power controller 150 disposed within the heat sink 140 to be electrically connected to the light emitting module 130 disposed on the cylindrical upper portion 141.

Meanwhile, either the area of the circular shape of the cylindrical upper portion 141 or the height of the cylindrical upper portion 141 may be changed according to the total area of the light emitting module 130 or the entire length of the power controller 150.

The cylindrical lower portion 143 includes a plurality of grooves 143*a* which are formed in the longitudinal direction thereof on the surface thereof. The plurality of the grooves 143*a* are radially arranged on the surface of the cylindrical lower portion 143. Such grooves 143*a* increase the surface area of the cylindrical lower portion 143 to improve the heat radiation efficiency of the heat sink 140.

Though the embodiment shows that the plurality of the grooves 143*a* are formed in the lower portion 143, the cylindrical upper portion 141 may also have the plurality of the grooves 143*a* having the same shapes as those of the plurality of the grooves 143*a* of the cylindrical lower portion 143. Also, the plurality of the grooves 143*a* formed on the surface of the cylindrical lower portion 143 can be extended to the cylindrical upper portion 141.

The heat sink 140 is made of a metallic material or a resin material which has excellent heat radiation efficiency. There is no limit to the material of the heat sink 140. For example, the material of the heat sink 140 can include at least any one of Al, Ni, Cu, Ag and Sn.

Though not shown in the drawings, a heat radiating plate (not shown) may be disposed between the light emitting module 130 and the heat sink 140. The heat radiating plate (not shown) can be made of a material having a high thermal conductivity such as a thermal conduction silicon pad or a thermal conduction tape and the like, and can effectively transfer heat generated by the light emitting module 130 to the heat sink 140.

<Power Controller>

The power controller 150 includes a support plate 151 and a plurality of parts 153 mounted on the support plate 151. The plurality of the parts 153 includes, for example, a DC converter converting AC power supplied by an external power supply into DC power, a driving chip controlling the driving of the light emitting module 130, and an electrostatic discharge (ESD) protective device for protecting the light emitting module 130, and the like. However, there is no limit to the parts.

<Inner Case>

The inner case 160 includes an insertion portion 161 inserted into the receiving groove 140*a* of the heat sink 140, and a connection terminal 163 electrically connected to an external power supply.

The inner case 160 is made of a material having excellent insulation and durability, for example, a resin material.

The insertion portion 161 has a cylindrical shape with an empty interior. The insertion portion 161 is inserted into the receiving groove 140*a* of the heat sink 140 and prevents an electrical short-circuit between the power controller 150 and the heat sink 140. Therefore, a withstand voltage of the lighting device 100 can be improved.

The connection terminal 163 is connected, for example, to an external power supply in the form of a socket. The connection terminal 163 includes a first electrode 163*a* at a lower apex thereof, a second electrode 163*b* on the lateral surface thereof, and an insulating member 163*c* between the first electrode 163*a* and the second electrode 163*b*. Electric power is supplied to the first electrode 163*a* and the second electrode 163*b* from an external power supply. Here, since the shape of the connection terminal 163 is variously changed according to the design of the lighting device 100, there is no limit to the shape of the connection terminal 163.

<Mechanical and Electrical Connection Structure between the Power Controller and the Inner Case>

The power controller 150 is disposed in the receiving groove 140*a* of the heat sink 140.

The support plate 151 of the power controller 150 is disposed perpendicularly to one side of the substrate 131 in order that the air flows smoothly in the inner case 160. Therefore, in this case, air flows up and down direction in the inner case 160 due to convection current, thereby improving the heat radiation efficiency of the lighting device 100, as compared with a case where the support plate 151 is disposed horizontally to the one side of the substrate 131.

Meanwhile, the support plate 151 can be disposed in the inner case 160 perpendicularly to the longitudinal direction of the inner case 160. There is no limit to how the support plate 151 is disposed.

The power controller 150 is electrically connected to the light emitting module 130 by means of a first wiring 150*a*, and is electrically connected to the connection terminal 163 of the inner case 160 by means of a second wiring 160*a*. More specifically, the second wiring 160*a* is connected to the first electrode 163*a* and the second electrode 163*b* of the connection terminal 163 and is supplied an electric power from an external power supply.

Further, the first wiring 150*a* passes through the through hole 141*a* of the heat sink 140 and connects the power controller 150 with the light emitting module 130.

<Outer Case>

The outer case 170 is coupled to the inner case 160 and receives the heat sink 140, the light emitting module 130 and the power controller 150 and the like.

Since the outer case 170 covers the heat sink 140, it is possible to prevent a burn accident and an electric shock. Also, a user can easily handle the lighting device 100.

The outer case 170 includes a ring structure 171, a cone-shaped body 173 having a opening, and a connection portion 175 that physically connects the ring structure 171 with the body 173.

The body 173 has a cone shape. The body 173 has a shape corresponding to that of the cylindrical lower portion 143 of the heat sink 140. The connection portion 175 is comprised of a plurality of ribs. An opening 'G2' is formed among the plurality of the ribs.

The outer case 170 is made of a material having excellent insulation and durability, for example, a resin material.

The structure of the aforementioned lighting device 100 allows the lighting device 100 to be substituted for a conventional incandescent bulb. Therefore, it is possible to use equipments for the conventional incandescent bulb without the use of a mechanical connection structure for a new lighting device or without the improvement of assembly.

Figure 4:
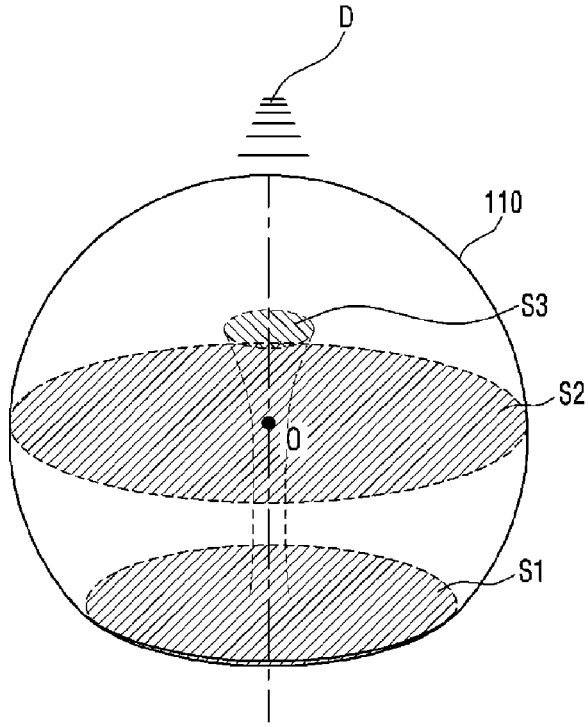
FIG. 4 is a view for describing the front light distribution characteristic based on the structures of both a cover 110 and a member 120 which are shown in FIG. 1.

FIG. 4 is a view for describing the front light distribution characteristic based on the structures of both a cover 110 and a member 120 which are shown in FIG. 1.

Referring to FIGS. 2 and 4, the area of the opening 'S1' of the cover 110 is less than that of the surface 'S2' passing through the center 'O' of the cover 110 and is greater than the area 'S3' of the top surface of the cone 123 of the member 120. Further, the area 'S3' of the top surface of the cone 123 of the member 120 is less than the area of the surface 'S2' passing through the center 'O' of the cover 110. Therefore, light emitted from the light emitting module 130 is not blocked by the member 120 and is distributed to the front of the cover 110.

Also, when the top surface of the cone 123 of the member 120 is located lower than the surface 'S2' passing through the center 'O' of the cover 110 and then when the light emitted from the light emitting module 130 is irradiated to the front of the cover 110, the light is blocked by the cone 123 of the member 120, so that a dark portion is generated in the cover 110. Therefore, the member 120 is located at the center of the opening 'G1' of the cover 110 and disposed toward the center 'O' of the cover 110. Subsequently, the top surface of the cone 123 of the member 120 is parallel with the opening 'G1' of the cover 110, and is located higher than the surface 'S2' passing through the center 'O' of the cover 110. As a result, the dark portion 'D' that may be generated in the front of the cover 110 can be prevented.

Figure 5:
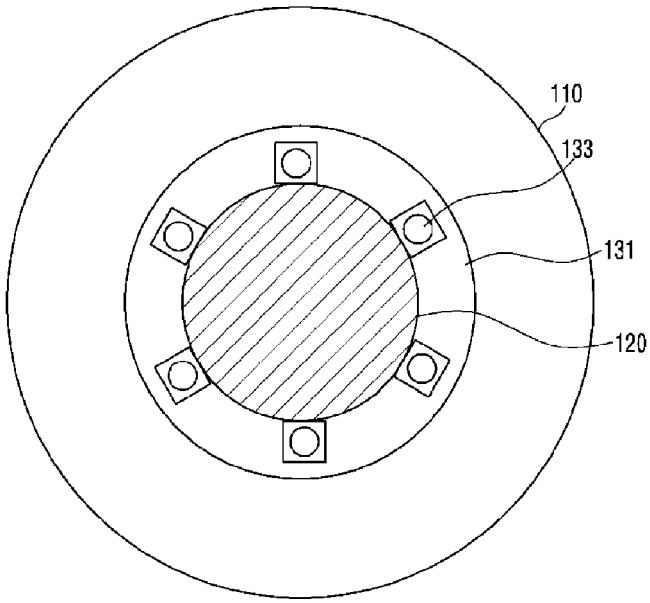
FIG. 5 is a plan view for describing the position relation between a light emitting module 130 and the member 120 which are shown in FIG. 1.
Figure 6:
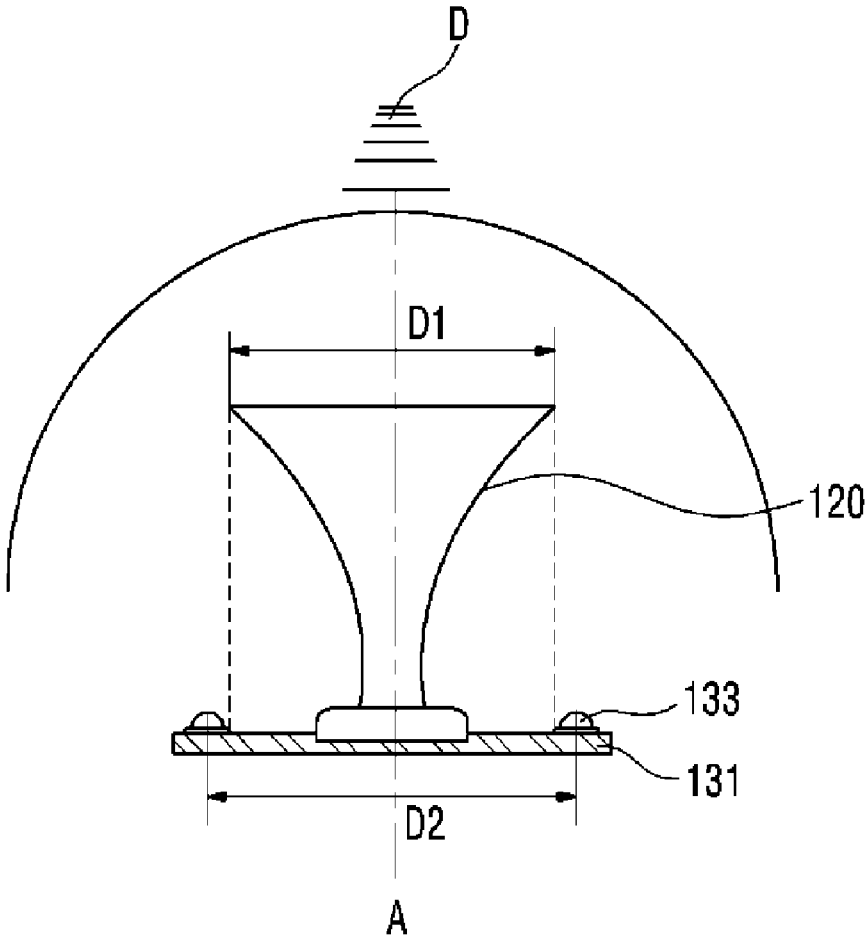
FIG. 6 is a cross sectional view for describing the position relation between a light emitting module 130 and the member 120 which are shown in FIG. 1.

FIG. 5 is a plan view for describing the position relation between a light emitting module 130 and the member 120 which are shown in FIG. 1. FIG. 6 is a cross sectional view for describing the position relation between a light emitting module 130 and the member 120 which are shown in FIG. 1.

Referring to FIGS. 5 and 6, the light emitting devices 133 disposed on the substrate 131 are radially arranged along the circumference of the substrate 131. Here, when light that is vertically emitted to the front of the cover from the light emitting devices 133 is blocked by the member 120, the dark portion 'D' is generated in the front of the cover 110, in particular, the central portion of the front of the cover 110, so that the light distribution characteristic is actually deteriorated. Therefore, it is an important issue how the member 120 is located relative to the plurality of the light emitting devices 133 arranged on the substrate 131. Accordingly, as shown in FIG. 5 in the embodiment of the present invention, when viewed vertically downward from the outer edge of the top surface of the member 120, the plurality of the light emitting devices 133 are radially arranged on the substrate 131 at least in such a manner that they are not blocked by the top surface of the member 120.

As shown in FIG. 6, the light emitting devices 133 are arranged on the substrate 131 such that a distance 'D2' between at least two light emitting devices 133 facing each other with respect to the central axis 'A' of the substrate 131 among the plurality of the light emitting devices 133 radially arranged is greater than a diameter 'D1' of the top surface of the member 120. Here, the central axis 'A' of the substrate 131 is aligned with the central axis 'A' of the member 120. Accordingly, the dark portion 'D' that may be generated in the front of the cover 110 can be more prevented.

Figure 7:
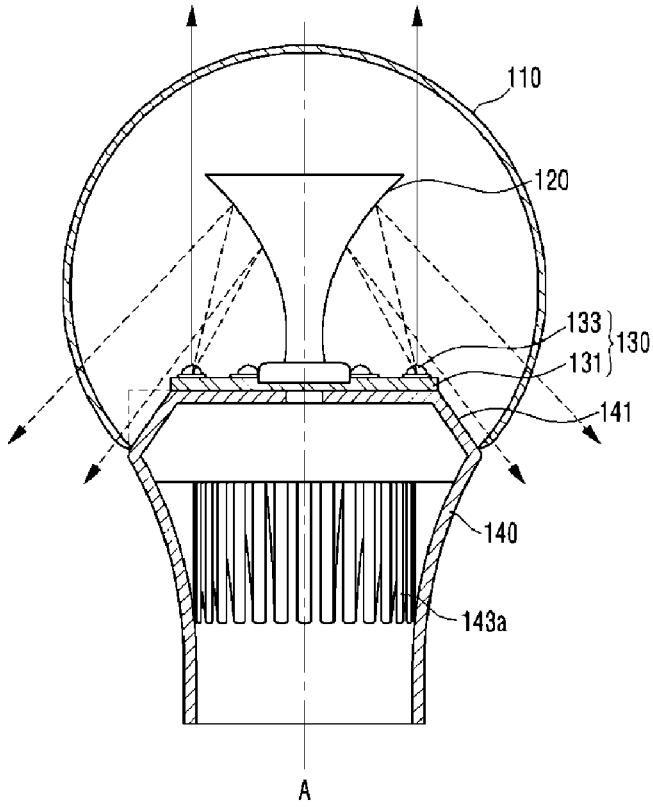
FIG. 7 is a view for describing the rear light distribution characteristic based on the positions of the member 120, the light emitting module 130 and the heat sink 140 which are shown in FIG. 1.

FIG. 7 is a view for describing the rear light distribution characteristic based on the positions of the member 120, the light emitting module 130 and the heat sink 140 which are shown in FIG. 1. Referring to FIG. 7, a part of the light generated from the light emitting module 130 is reflected by the member 120 and is irradiated to the rear of the cover 110. In this case, when there is no obstruction to the path of the light irradiated to the rear of the cover 110, the light distribution characteristic can be fully obtained on the rear of the cover 110.

Accordingly, as shown in FIG. 7, the outer circumferential surface of the cylindrical upper portion 141 of the heat sink 140 is inclined with respect to the central axis 'A' of the heat sink 140. As a result, since the light reflected by the member 120 is irradiated to the rear of the cover 110 without disturbance, the rear light distribution characteristic can be improved.

Figure 8:
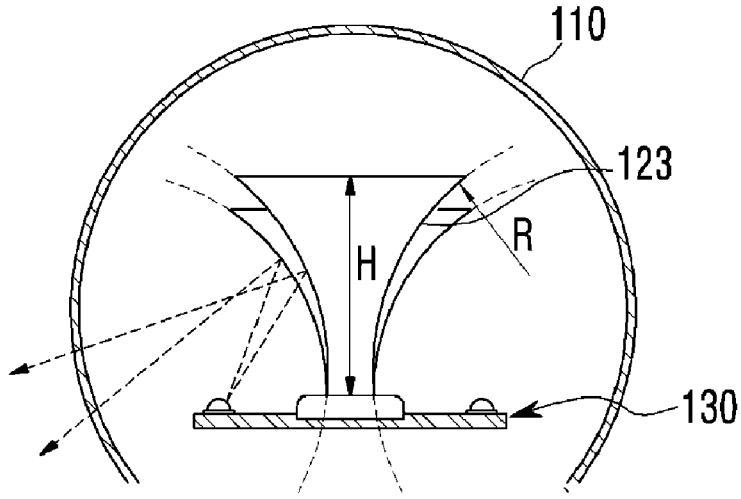
FIG. 8 is a view for describing the rear light distribution characteristic based on the member 120 shown in FIG. 1, particularly, a height of the cone 123 and a curvature radius of the curved surface of the member 120.

FIG. 8 is a view for describing the rear light distribution characteristic based on the member 120 shown in FIG. 1, particularly, the height of the cone 123 and the curvature radius of the curved surface of the member 120.

Referring to FIG. 8, under the state where the cone 123 has a certain height 'H', the path of the light generated from the light emitting module 130 may be changed according to a curvature radius 'R' of the curved surface of the cone 123. In other words, when the curvature radius 'R' of the cone 123 increases, the distribution of the light reflected by the cone 123 increases in the rear of the cover 110. When the curvature radius 'R' of the cone 123 decreases, the distribution of the light reflected by the cone 123 relatively decreases in the rear of the cover 110. Therefore, in order to improve the rear light distribution characteristic under the state where the cone 123 has a certain height 'H', it is recommended that the curvature radius 'R' of the cone 123 of the member be increased.

Meanwhile, under the state where the curved surface of the cone 123 of the member has a certain curvature radius 'R', the path of the light generated from the light emitting module 130 may be changed according to the height 'H' of the cone 123. In other words, when the height 'H' of the cone 123 increases, the distribution of the light reflected by the cone 123 increases in the rear of the cover 110. When the height 'H' of the cone 123 decreases, the distribution of the light reflected by the cone 123 relatively decreases in the rear of the cover 110. Therefore, in order to improve the rear light distribution characteristic under the state where the curved surface of the cone 123 has a certain curvature radius 'R', it is recommended that the height 'H' of the cone 123 of the member be increased.

Figure 9:
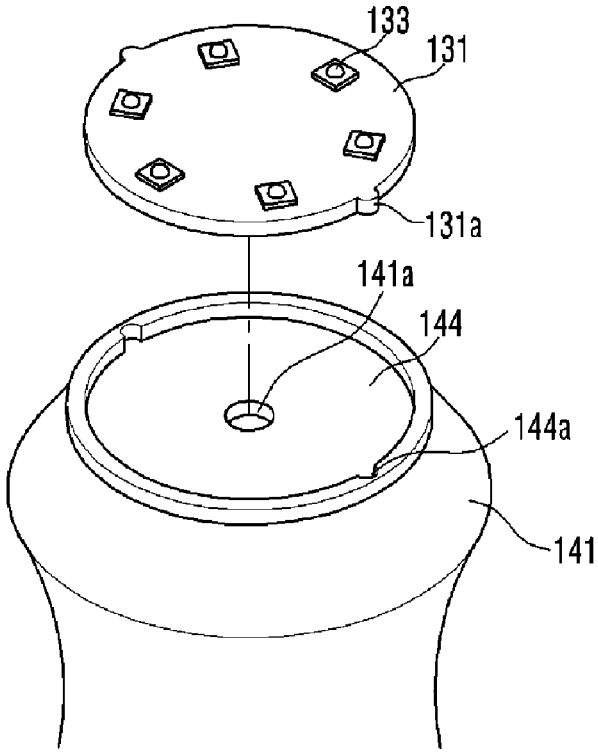
FIG. 9 is a view for describing another example of how the heat sink 140 shown in FIG. 2 is coupled to the light emitting module 130 shown in FIG. 2.

FIG. 9 is a view for describing another example of how the heat sink 140 shown in FIG. 2 is coupled to the light emitting module 130 shown in FIG. 2.

Figure 10:
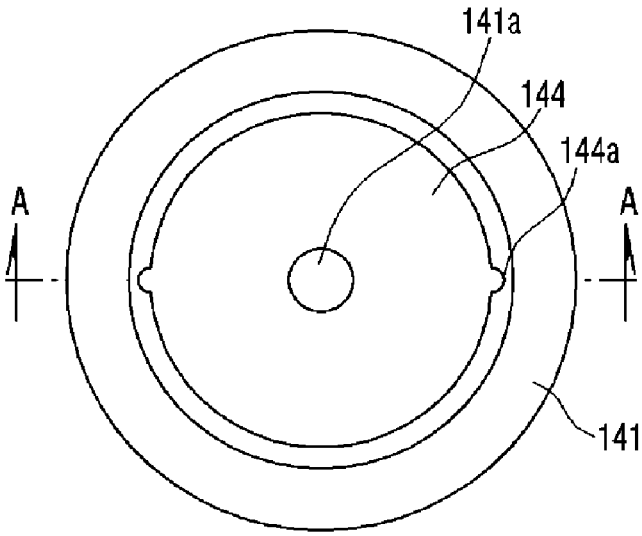
FIG. 10 is a top view of FIG. 9.

Referring to FIGS. 9 and 10, the heat sink 140 includes a seating portion 144. The seating portion 144 has a predetermined depth in the top surface of the cylindrical upper portion 141. The outer circumference defining the seating portion 144 has at least one groove 144*a*. As shown, the seating portion 144 has a circular shape and may have any shape corresponding to the shape of the substrate 131. The groove 144*a* formed in the outer circumference of the seating portion 144 can be disposed inwardly or outwardly from the outer circumference of the seating portion 144.

Since the structure of the light emitting module 130 has been described above, a description thereof will be omitted. However, the outer circumference of the substrate 131 having a circular shape includes a protruding portion 131*a* that is inserted into the groove 144*a* of the of the seating portion 144 of the heat sink 140. The protruding portion 131*a* extends outwardly from the outer circumference of the substrate 131.

Meanwhile, it has been described above that the substrate 131 includes the protruding portion 131*a*. However, when the seating portion 144 includes a protruding portion (not shown) instead of the groove 144*a*, the substrate 131 includes a groove (not shown) into which the protruding portion (not shown) of the seating portion 144 is inserted.

Such a coupling structure between the heat sink 140 and the light emitting module 130 prevents the substrate 131 from rotating or separating. Therefore, alignment characteristic between the heat sink 140 and the light emitting module 130 can be improved.

Figure 11:
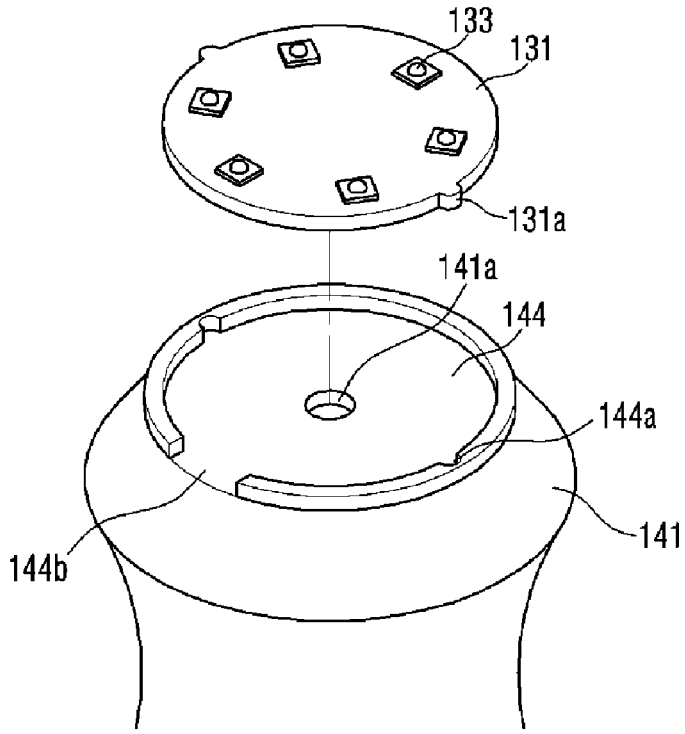
FIG. 11 is a perspective view for describing further another example of how the heat sink 140 shown in FIG. 2 is coupled to the light emitting module 130 shown in FIG. 2.
Figure 12:
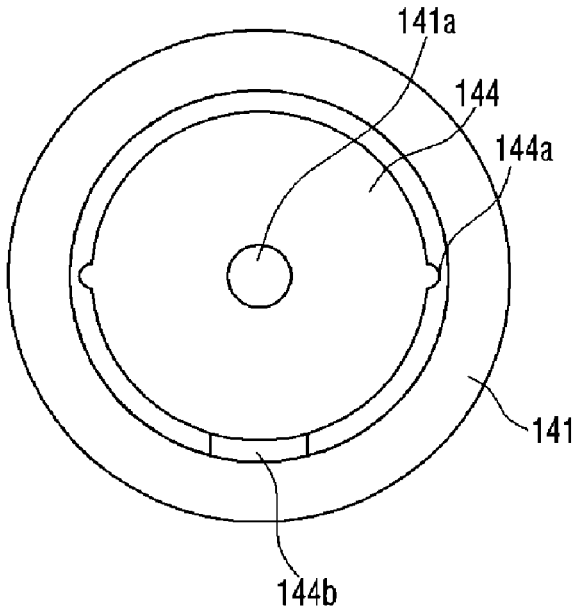
FIG. 12 is a top view of FIG. 11.

FIG. 11 is a perspective view for describing further another example of how the heat sink 140 shown in FIG. 2 is coupled to the light emitting module 130 shown in FIG. 2. FIG. 12 is a top view of FIG. 11.

Referring to FIGS. 11 and 12, since the structure of the light emitting module 130 is the same as that of the light emitting module 130 shown in FIG. 9, a description thereof will be omitted. Also, the structure of the heat sink 140 is almost the same as that of the heat sink 140 shown in FIG. 9. However, the seating portion 144 of the heat sink 140 of FIG. 11 further includes an opening 143*b*.

The coupling structure between the heat sink 140 and the light emitting module 130 which are shown in FIGS. 11 and 12 can improve the alignment characteristic between the heat sink 140 and the light emitting module 130. Moreover, when the light emitting module 130 needs repairing, the coupling structure allows the light emitting module 130 to be readily separated from the heat sink 140. Therefore, it is more convenient to perform a work.

Figure 13:
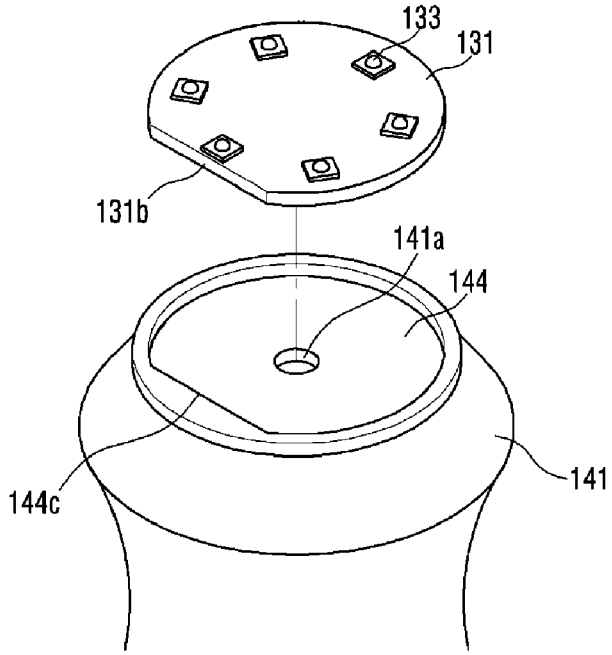
FIG. 13 is a perspective view for describing yet another example of how the heat sink 140 shown in FIG. 2 is coupled to the light emitting module 130 shown in FIG. 2.
Figure 14:
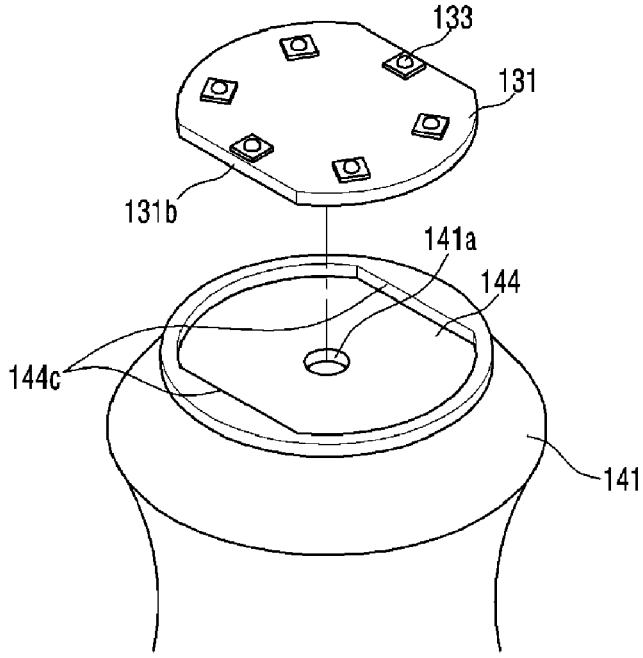
FIG. 14 is a perspective view showing a modified example of FIG. 13.

FIG. 13 is a perspective view for describing yet another example of how the heat sink 140 shown in FIG. 2 is coupled to the light emitting module 130 shown in FIG. 2. FIG. 14 is a perspective view showing a modified example of FIG. 13.

Referring to FIGS. 13 and 14, the heat sink 140 includes the seating portion 144. A portion of the circumference of the seating portion 144 includes at least one guide. Here, the guide includes a straight portion 143*c*. Also, the substrate 131 of the light emitting module 130 has a structure corresponding to the shape of the seating portion 144. That is, a portion of the circumference of the substrate 131 includes at least one guide. Here, the guide includes a straight portion 131*b*. The substrate 131 is seated in the seating portion 144 of the heat sink 140. The guides of the seating portion 144 and the substrate 131 allow the light emitting module 130 to be disposed on the top surface of the heat sink 140 in a certain direction.

Not shown in the drawings, the outer circumference of the seating portion 144 of the heat sink 140 may includes not only the straight portion 143*c* but also a groove in order to more improve the alignment characteristic between the light emitting module 130 and the heat sink 140.

Figure 15A:
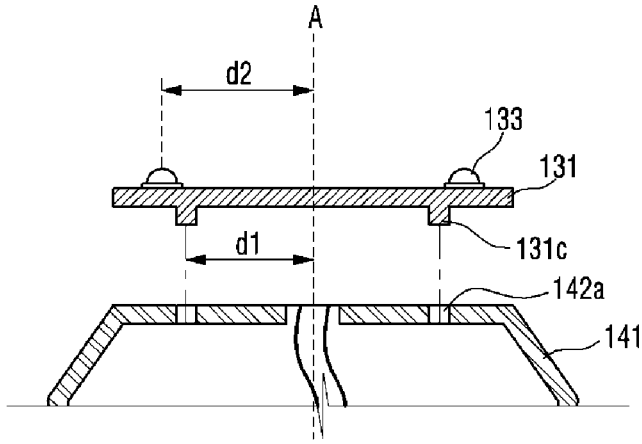
FIGS. 15*a* to 15*c* are cross sectional views for describing still another example of how the heat sink 140 shown in FIG. 2 is coupled to the light emitting module 130 shown in FIG. 2.
Figure 15B:
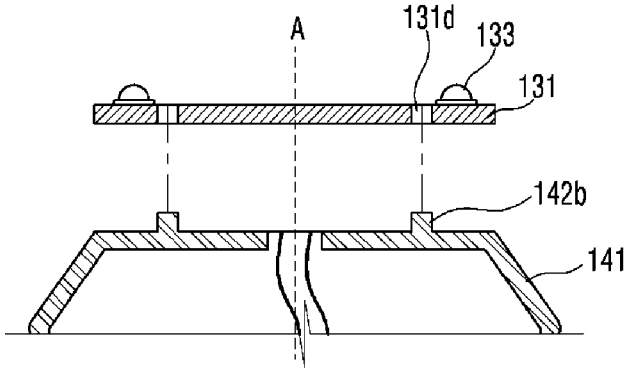
Figure 15C:
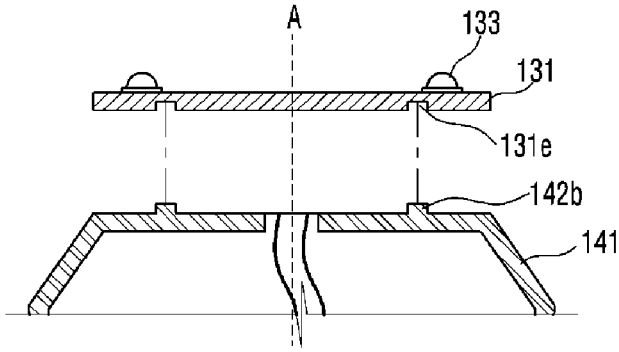

FIGS. 15*a* to 15*c* are cross sectional views for describing still another example of how the heat sink 140 shown in FIG. 2 is coupled to the light emitting module 130 shown in FIG. 2.

First, in FIGS. 15*a* to 15*c*, a description of the structures which are the same as or similar to those of the heat sink 140 and the light emitting module 130 will be omitted.

Referring to FIG. 15*a*, the top surface of the cylindrical upper portion 141 of the heat sink 140 includes at least one groove (not shown) or hole 142*a*. The bottom surface of the substrate 131 of the light emitting module 130 includes a projection 131*c*. The projection 131*c* extends outward from the bottom surface of the substrate 131.

The projection 131*c* is inserted into the groove (not shown) or the hole 142*a* of the heat sink 140, so that the heat sink 140 is coupled to the light emitting module 130. Therefore, since the projection 131*c* and either the groove (not shown) or hole 142*a* fix the heat sink 140 to the light emitting module 130, the alignment characteristic can be improved.

The light emitting device 133 placed on the top surface of the substrate 131 is disposed farther from the central axis 'A' of the substrate 131 than the projection 131*c* placed on the bottom surface of the substrate 131. That is, a straight-line distance 'd1' from the central axis 'A' of the substrate 131 to the projection 131*c* is less than a straight-line distance 'd2' from the central axis 'A' of the substrate 131 to the plurality of the light emitting devices 133. When the plurality of the light emitting devices 133 and the projection 131*c* are arranged in the aforementioned manner, it is more convenient to couple the light emitting module 130 with the heat sink 140.

Referring to FIGS. 15*b* and 15*c*, the heat sink 140 includes at least one projection 142*b* on the top surface thereof. The substrate 131 of the light emitting module 130 includes either a hole 131*d* into which the projection 142*b* of the heat sink 140 is inserted or a groove 131*e* into which the projection 142*b* of the heat sink 140 is inserted. Therefore, like the structure shown in FIG. 15*a*, the heat sink 140 and the light emitting module 130 are fixed to each other without moving and the alignment characteristic is improved.

Since the position relation between the light emitting device 133 disposed on the substrate 131 and either the hole 131*d* or the groove 131*e* is the same as the position relation shown in FIG. 15*a*, a description thereof will be omitted.

Figure 16:
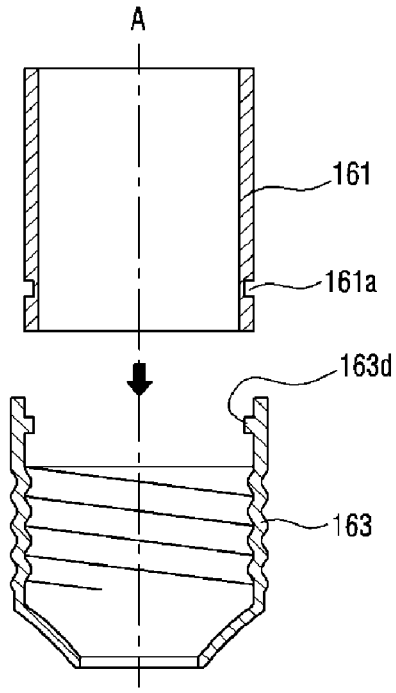
FIG. 16 is an exploded cross sectional view of the inner case shown in FIG. 2.
Figure 17:
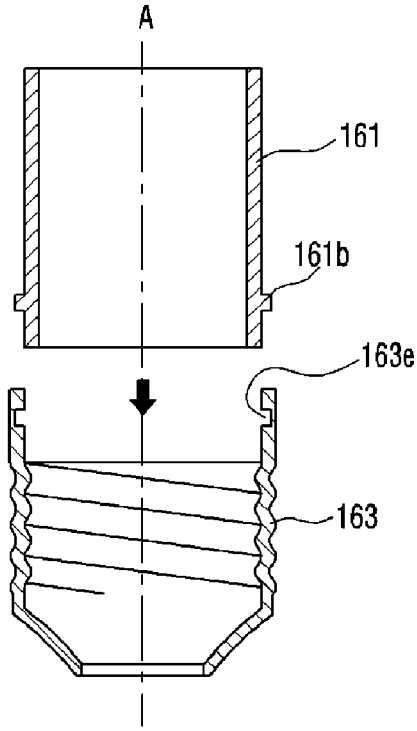
FIG. 17 is an exploded cross sectional view of a modified example of the inner case shown in FIG. 16.
Figure 18:
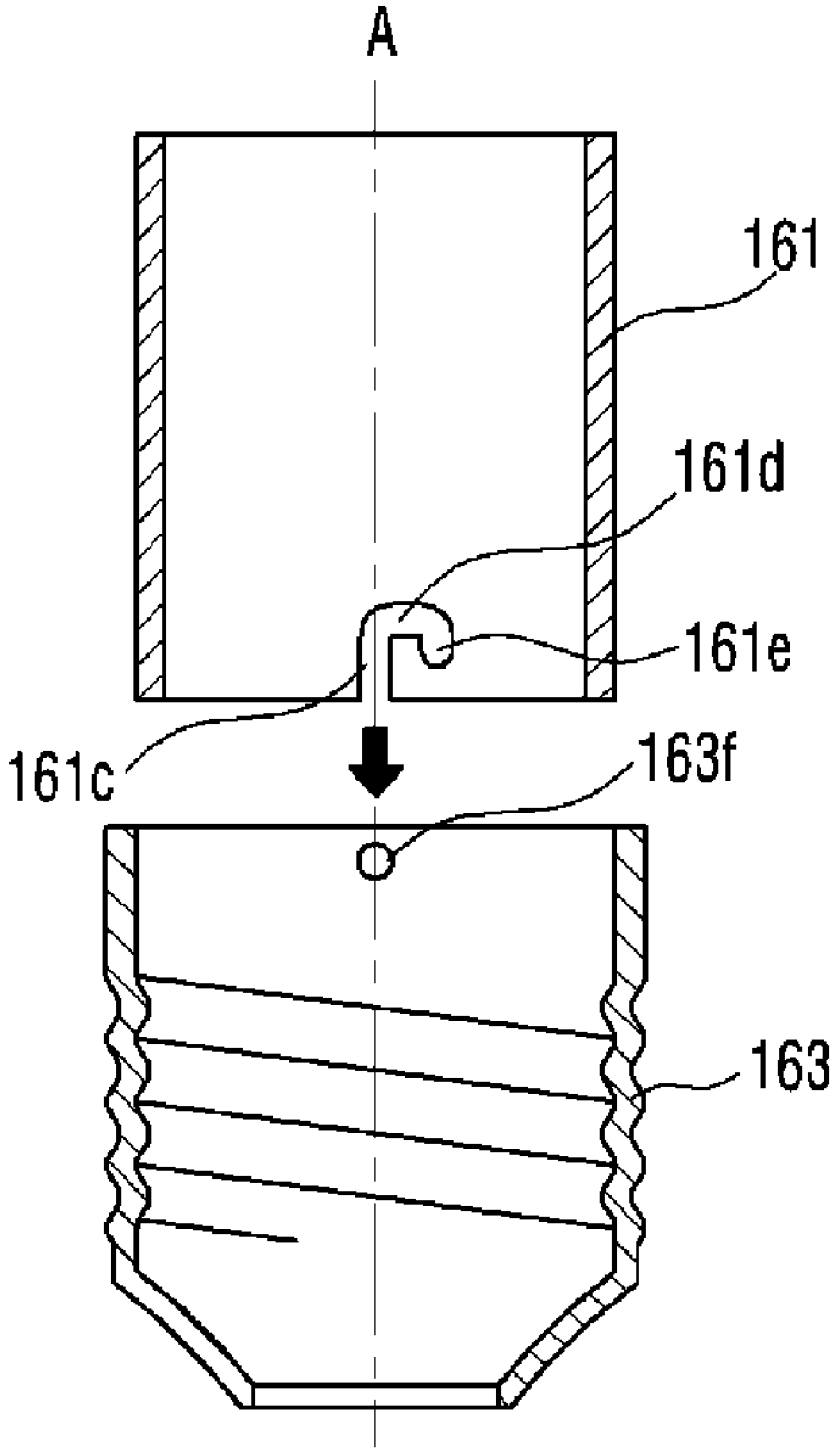
FIG. 18 is an exploded cross sectional view of another modified example of the inner case shown in FIG. 16.

FIG. 16 is an exploded cross sectional view of the inner case shown in FIG. 2. FIG. 17 is an exploded cross sectional view of a modified example of the inner case shown in FIG. 16. FIG. 18 is an exploded cross sectional view of another modified example of the inner case shown in FIG. 16.

Referring to FIGS. 16 to 18, the inner case 160 includes both a circular insertion portion 161 having a opening and the connection terminal 163 surrounding the outer surface of one side of the insertion portion 161.

First, referring to FIG. 16, the insertion portion 161 includes at least one groove 161*a* in the outer surface thereof. The groove 161*a* may extend horizontally with respect to one side end of the insertion portion 161.

Though the embodiment shows that the insertion portion 161 has a circular shape, the insertion portion 161 can have any shape that can be inserted into the receiving groove 140*a* of the heat sink 140. When the insertion portion 161 includes two or more grooves 161*a*, at least two grooves 161*a* are disposed to face each other with respect to the central axis 'A' of the insertion portion 161. Accordingly, the insertion portion 161 can be stably fixed to the connection terminal 163.

Also, insertion portion 161 is made of an insulating material for preventing an electrical short-circuit between the power controller 150 and the heat sink 140.

The connection terminal 163 may be made of an elastic material. The connection terminal 163 includes a protruding portion 163*d* extending outward from the inner surface thereof. The protruding portion 163*d* is inserted into the groove 161*a* of the insertion portion 161. That is, the protruding portion 163*d* of the connection terminal 163 is inserted into the groove 161*a* of the insertion portion 161 by pushing and fixing the insertion portion 161 into the connection terminal 163.

Referring to FIG. 17, the outer surface of the insertion portion 161 includes at least one protruding portion 161*b*. The protruding portion 161*b* may have a rectangular shape extending horizontally with respect to one side end of the insertion portion 161.

Though the embodiment shows that the insertion portion 161 has a circular shape, the insertion portion 161 can have any shape that can be inserted into the receiving groove 140*a* of the heat sink 140. When the insertion portion 161 includes two or more protruding portions 161*b*, at least two protruding portions 161*b* are disposed to face each other with respect to the central axis 'A' of the insertion portion 161. Accordingly, the insertion portion 161 can be stably fixed to the connection terminal 163.

Also, insertion portion 161 is made of an insulating material for preventing an electrical short-circuit between the power controller 150 and the heat sink 140.

The connection terminal 163 may be made of an elastic material. The connection terminal 163 includes a groove 163*e* depressed into the inner surface thereof. The protruding portion 161*b* of the insertion portion 161 is inserted into the groove 163*e*. That is, the protruding portion 161*b* of the insertion portion 161 is inserted into the groove 163*e* of the connection terminal 163 by pushing and fixing the insertion portion 161 into the connection terminal 163.

Referring to FIG. 18, the insertion portion 161 includes a first guide groove 161*c* disposed perpendicularly to one side end of the insertion portion 161, a second guide groove 161*d* that is connected to the end of the first guide groove 161*c* and disposed perpendicularly to the first guide groove 161*c*, and a locking projection 161*e* formed at the end of the second guide groove 161*d*.

When the insertion portion 161 includes a plurality of the first and the second guide grooves 161*c* and 161*d* and a plurality of the locking projections 161*e*, at least two first guide grooves 161*c*, at least two second guide grooves 161*d* and at least two locking projections 161*e* are disposed to face each other respectively with respect to the central axis 'A' of the insertion portion 161. Accordingly, the insertion portion 161 can be stably fixed to the connection terminal 163.

Also, insertion portion 161 is made of an insulating material for preventing an electrical short-circuit between the power controller 150 and the heat sink 140.

The connection terminal 163 may be made of an elastic material. The connection terminal 163 includes a protruding portion 163*f* on the inner surface thereof. The protruding portion 163*f* is fitted to the first guide groove 161*c* of the insertion portion 161 and moves upward along the first guide groove 161*c*, moves along the second guide groove 161*d* from left to right or right to left, and then is seated in the locking projection 161*e*.

Figure 19:
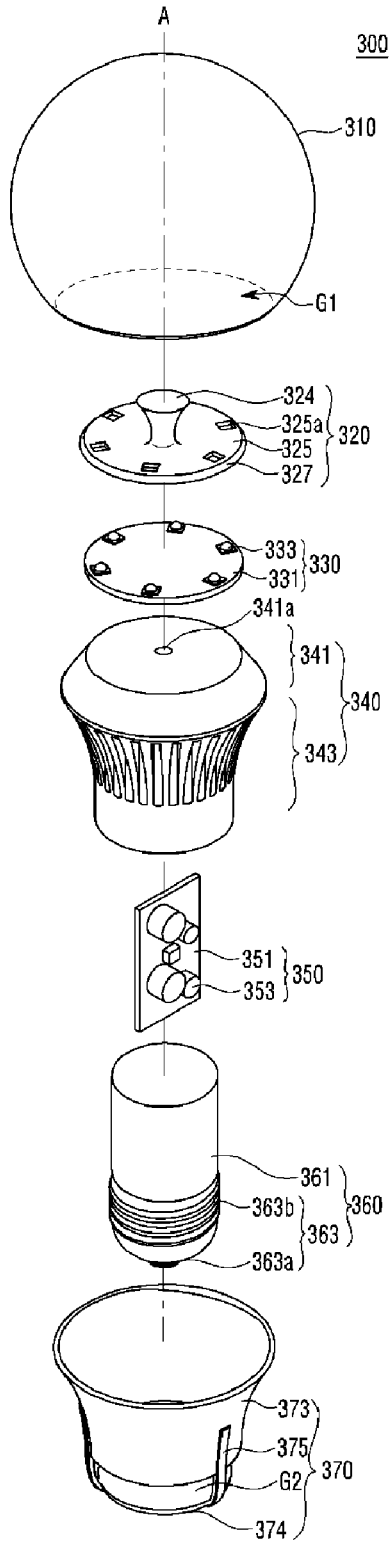
FIG. 19 is an exploded perspective view showing a lighting device according to another example of the present invention.

FIG. 19 is an exploded perspective view showing a lighting device according to another example of the present invention.

Referring to FIG. 19, a lighting device 300 according to another embodiment of the present invention includes a cover 310, a member 320, a light emitting module 330, a heat sink 340, a power controller 350, an inner case 360 and an outer case 370. Since the lighting device 300 includes the same components as those of the lighting device shown in FIG. 2 with exception of the member 320 and the light emitting module 330, the repetitive descriptions thereof will be omitted.

The member 320 includes a base 325 having a flat disk shape, a ring structure 327 extending from the outer circumference of the base 325, and a projection 324 projecting upward along the central axis 'A' of the base 325. Though FIG. 19 shows that the member 320 includes the projection 324 functioning as a reflector, the member 320 may include the base 325 and the ring structure 327 without the projection 324.

The light emitting module 330 includes a substrate 331 and a plurality of light emitting devices 333. Compared with the substrate 131 shown in FIG. 2, the substrate 331 has a flat disk shape without a insertion groove. Here, the substrate 331 may have not only the flat disk shape but also various shapes including a quadrangular shape and a hexagonal shape and the like.

Also, distances from the plurality of the light emitting devices 333 to the ring structure 327 of the member 320 are actually the same as each other. Therefore, it is possible to obtain a uniform optical orientation angle or a uniform light distribution characteristic.

Figure 20:
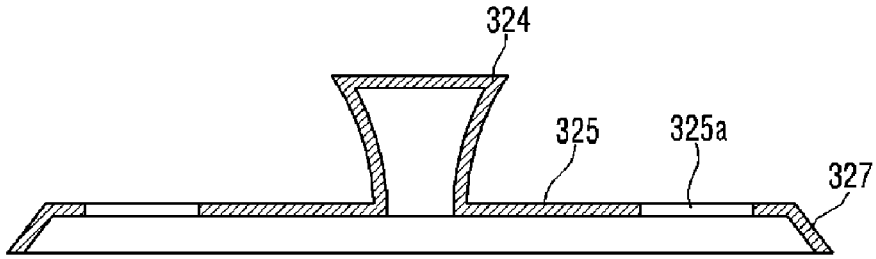
FIGS. 20 to 22 are cross sectional views showing various modified examples of the member 320 shown in FIG. 19.
Figure 21:
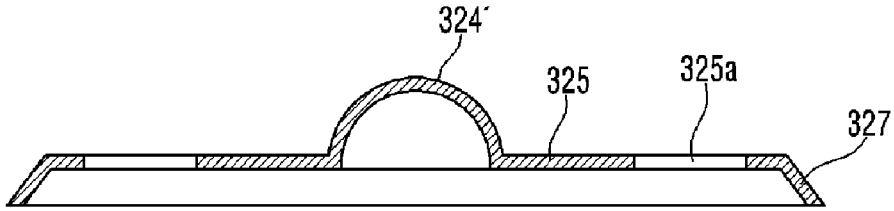
Figure 22:
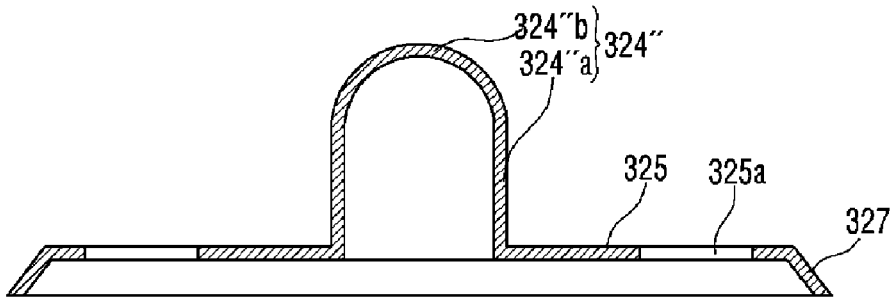

FIGS. 20 to 22 are cross sectional views showing various modified examples of the member 320 shown in FIG. 19. Each of the various modified examples of FIGS. 20 to 22 will be described with reference to FIG. 19.

First, as shown in FIG. 20, the member includes the base 325, the projection 324 projecting from the central portion of the base 325, and the ring structure 327 extending outward from the outer circumference of the base 325.

The base 325 includes a plurality of holes 325*a*. The plurality of the light emitting devices 133 shown in FIG. 19 are respectively inserted into the plurality of the holes 325*a*, so that the plurality of the light emitting devices 133 are exposed on the top surface of the member 320. The base 325 can have not only the flat disk shape but also any shape capable of surrounding or covering the substrate 331 disposed under the member 320, for example, a hexagonal shape and other various shapes and the like.

The projection 324 has a cone shape extending upward from the central portion of the top surface of the base 325 and having a diameter that increases toward the top thereof. The ring structure 327 extends outward from the outer circumference of the base 325 and is inclined toward the substrate 331 shown in FIG. 19. As such, when light generated from the light emitting module 330 is reflected by the cover 310 and is irradiated to the rear of the cover 310, the ring structure 327 inclined toward the substrate 331 is not obstructive to the path of the light. Therefore, the rear light distribution characteristic of the cover 310 can be improved.

Referring to FIG. 21, the member shown in FIG. 21 includes the base 325 and the ring structure 327, which are shown in FIG. 20, and a projection 324'. The projection 324' has a hemispherical shape extending upward from the central portion of the top surface of the base 325.

Referring to FIG. 22, the member shown in FIG. 22 includes the base 325 and the ring structure 327, which are shown in FIG. 20, and a projection 324". The projection 324" includes a hemisphere part 324"*b* and an extension part 324"*a*. The extension part 324"*a* extends vertically upward from the central portion of the top surface of the base 325 and has a certain diameter. The hemisphere part 324"*b* extends upward from the end of the extension part 324"*a* and has a curved surface.

Figure 23:
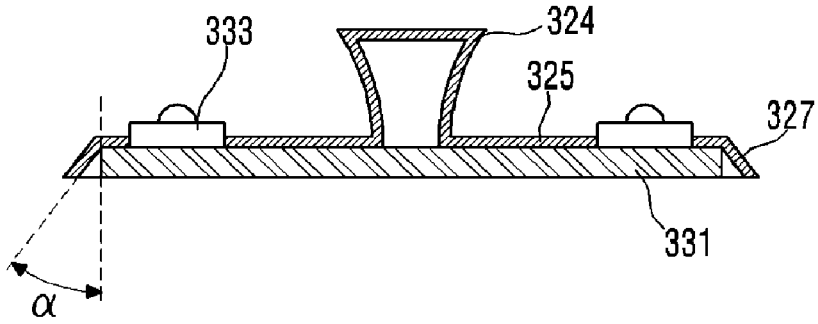
FIG. 23 is a cross sectional view for describing how the substrate 331 shown in FIG. 19 is coupled to the member 320 shown in FIG. 19.

FIG. 23 is a cross sectional view for describing how the substrate 331 shown in FIG. 19 is coupled to the member 320 shown in FIG. 19.

As shown in FIG. 23, the light emitting devices 333 disposed on the substrate 331 are inserted into the holes 325*a* of the member 320 and exposed to the outside. The ring structure 327 of the member 320 extends from the outer circumference of the base 325 of the member 320 and is inclined toward the substrate 331. Here, an angle formed by the lateral surface of the substrate 331 and the bottom surface of the ring structure 327 is a right angle or an acute angle ($\alpha$). Also, in order to readily couple the light emitting devices 333 to the member 320, one side of the ring structure 327 forms an acute angle with one side of the base 325.

The end of the ring structure 327 may be placed on an imaginary plane that is on the same line with the bottom surface of the substrate 331. Therefore, the end of the ring structure 327 contacts with the flat surface of the heat sink 340 disposed under the substrate 331 and improves alignment among the member 320, light emitting module 330 and the heat sink 340.

Figure 24:
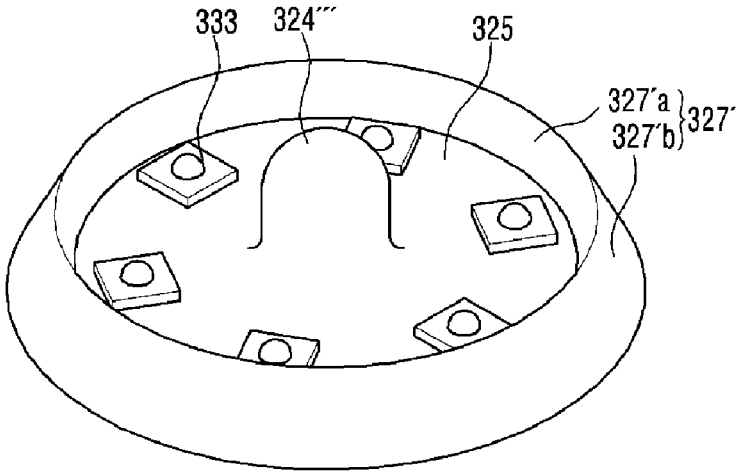
FIG. 24 is a perspective view of a modified example of the member 320 shown in FIG. 19.
Figure 25:
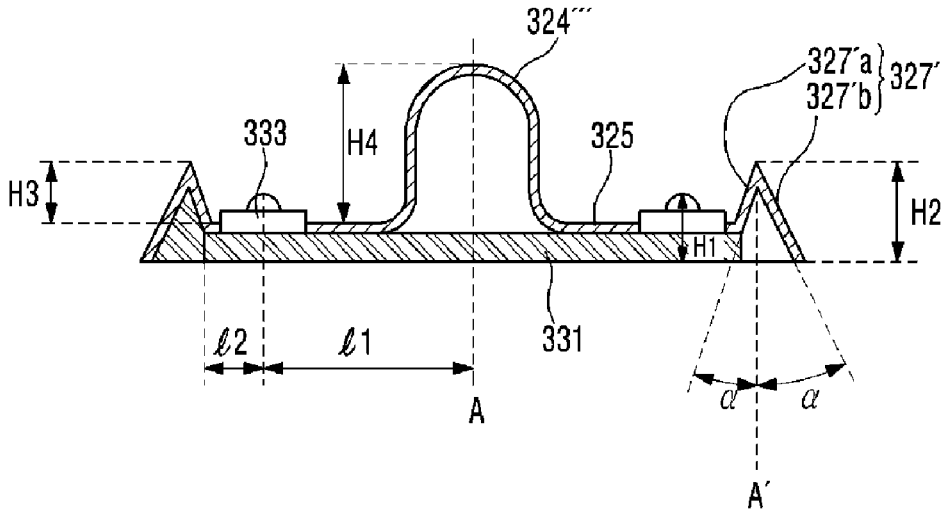
FIG. 25 is a cross sectional view for describing how the member shown in FIG. 24, the substrate 331 and the light emitting device 333 are coupled to each other.
Figure 26:
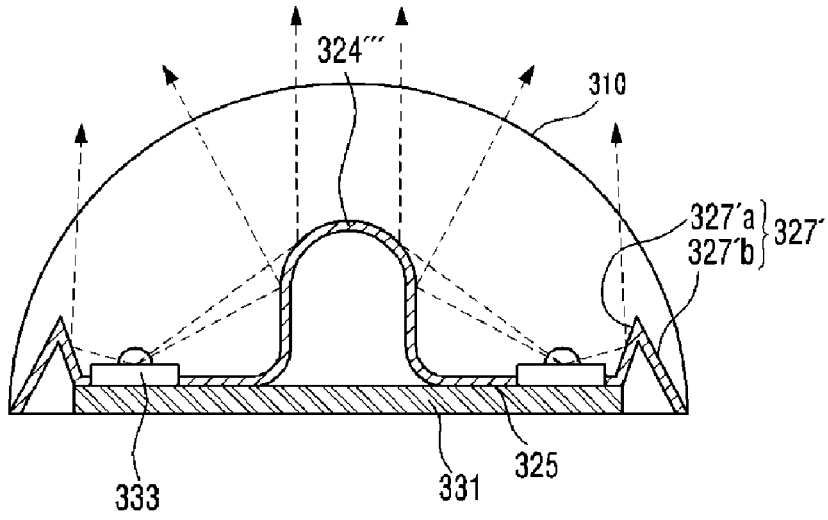
FIG. 26 is a cross sectional view for describing the optical path characteristic of the light emitting device 333 shown in FIG. 24.

FIG. 24 is a perspective view of a modified example of the member 320 shown in FIG. 19. FIG. 25 is a cross sectional view for describing how the member shown in FIG. 24, the substrate 331 and the light emitting device 333 are coupled to each other. FIG. 26 is a cross sectional view for describing the optical path characteristic of the light emitting device 333 shown in FIG. 24.

Referring to FIGS. 24 to 26, the plurality of the light emitting devices 333 disposed on the substrate 331 are inserted into the holes of the base 325 and exposed on the top surface of the member.

The plurality of the light emitting devices 333 are radially disposed from the central axis 'A' of the projection 324'''. Distances from the central axis 'A' to the light emitting devices 333 are actually the same as each other.

While the projection 324''' has a similar structure to that of the projection 324'' shown in FIG. 22, the projection 324''' can have any structure having a shape projecting upward from the base 325.

The peak of the projection 324''' is at least located higher than the plurality of the light emitting devices 333. As a result, since light generated from the light emitting devices 333 is irradiated to the projection 324''' and reflected by the projection 324''', the front light distribution characteristic of the cover 310 can be improved.

The ring structure 327' includes a first ring 327'*a* extending from the outer circumference of the base 325 and a second ring 327'*b* extending from the first ring 327'*a*.

The first ring 327' *a* functions as a reflective surface reflecting the light emitted from the light emitting devices 333. The first ring 327' a is coated with a reflective material in order to reflect the light.

The first ring 327'*a* is inclined in an opposite direction to the substrate 331 with respect to the top surface of the base 325, that is, is inclined upward at a first inclination. In other words, the first ring 327'*a* is inclined at an obtuse angle with respect to the one side of the substrate 331. Such a first ring 327'*a* is able to irradiate the light emitted by the light emitting devices 333 to the front of the cover 310, so that the light is prevented from being irradiated to unnecessary portions, and optical loss can be reduced.

The second ring 327'*b* extends from the first ring 327'*a* and is inclined at a second inclination toward the substrate 331. That is, the second ring 327'*b* has an inclined surface bent from the first ring 327'*a*. Though not shown, the second ring 327'*b* is not obstructive to the path of the light generated from the light emitting devices 333 is reflected by the cover 310 and is irradiated to the rear of the cover 310. Therefore, the rear light distribution characteristic of the cover 310 can be improved.

An angle between the first ring 327'*a* and the second ring 327'*b* will be described as follows. With respect to a reference axis 'A'' passing through a portion the first ring 327'*a* and the second ring 327'*b* are in contact with each other, one sides of the first ring 327'*a* and the second ring 327'*b* are inclined at the same angle 'α' with respect to the axis 'A''. As such, the inclinations of the first ring 327'*a* and the second ring 327'*b* are the same as each other such that the member is readily injected and manufactured.

Meanwhile, a maximum height 'H2' from a plane that is on the same line with the bottom surface of the substrate 331 to the end of the ring structure 327' is greater than a height 'H1' from the bottom surface of the substrate 331 to the imaginary light emitting surface of the light emitting device 333. This is because it is required that the ring structure 327' should be placed in a minimum position for reflecting the light emitted by the light emitting devices 333 to the front of the cover 310. However, it is recommended that the maximum height 'H2' of the ring structure 327' should not be increased infinitely and should be approximately one and a half times as much as 'H1'. This is because, when the maximum height 'H2' of the ring structure 327' is greater than 'H1' and less than about one and a half times 'H1', it is possible to obtain the appropriate front/rear light distribution characteristics of the lighting device.

A height 'H4' from the top surface of the base 325 to the peak of the projection 324''' is greater than a height 'H3' from the top surface of the base 325 to the peak of the ring structure 327'. This intends that the light reflected by the ring structure 327' is irradiated to the projection 324''' and is irradiated in various directions to the front of the cover 310. As a result, the front light distribution characteristic of the cover 310 can be improved. Though FIG. 26 shows that the height of the projection 324''' is greater than the height of the ring structure 327', the height of the projection 324''' is not limited to this. In other words, the height of the projection 324''' is changed according to the orientation angle of the light generated from the light emitting device 333 such that the light is irradiated to the front of the cover 310, or the height of the projection 324''' may be actually the same as the height of the ring structure 327'.

A straight-line distance 'l1' from the central axis 'A' of the base 325 to the central axis of the light emitting device 333 is greater than a straight-line distance 'l2' from the central axis of the light emitting device 333 to the inner circumference of the first ring 327'*a*. This is because, when the light emitting device 333 having a predetermined orientation angle is disposed as farther as possible from the central axis 'A' of the base 325, the front light distribution characteristic of the cover 310 can be obtained.

Figure 27:
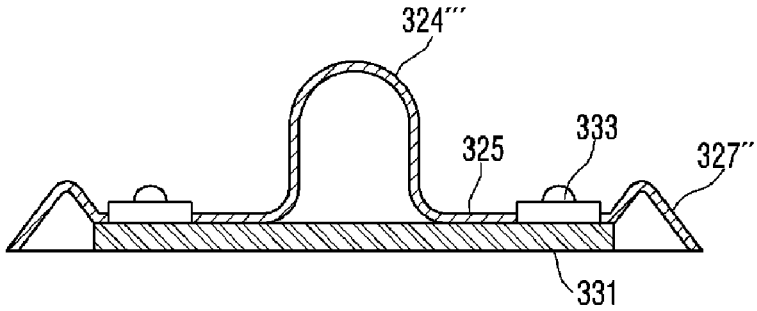
FIG. 27 is a cross sectional view for showing a modified example of the member shown in FIG. 24 and for describing how the member is coupled to the substrate 331.

FIG. 27 is a cross sectional view for showing a modified example of the member shown in FIG. 24 and for describing how the member is coupled to the substrate 331.

The coupling structure shown in FIG. 27 between the member and the substrate 331 is the same as the coupling structure shown in FIG. 25. Therefore, the repetitive description will be omitted.

However, the end of a ring structure 327'' has a curved surface. Here, the end of a ring structure 327'' has the maximum height from the bottom surface of the substrate 331. As such, since the end of a ring structure 327'' has the curved surface, mechanical structural vulnerability can be overcome unlike FIG. 15.

Figure 28:
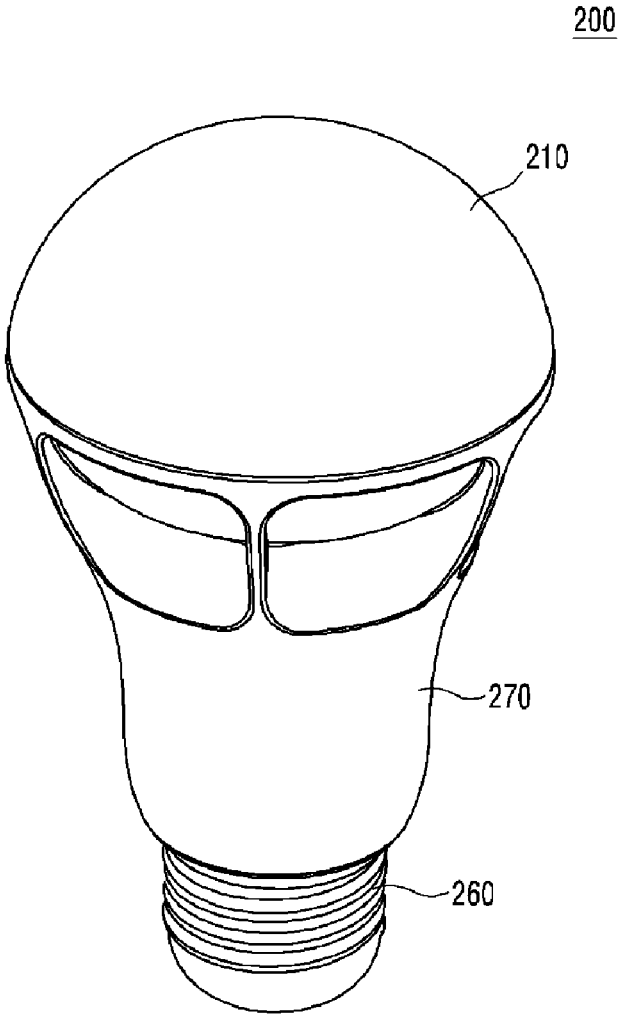
FIG. 28 is a perspective view showing a lighting device 200 according to further another embodiment of the present invention.
Figure 29:
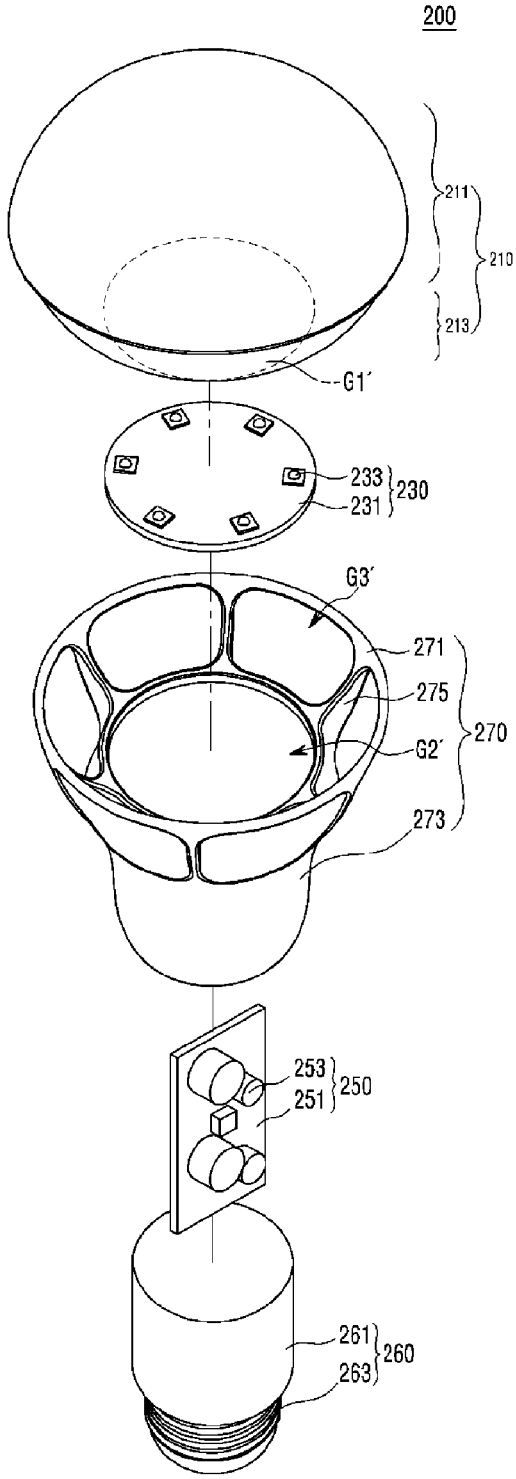
FIG. 29 is an exploded perspective view of the lighting device 200 shown in FIG. 28.
Figure 30:
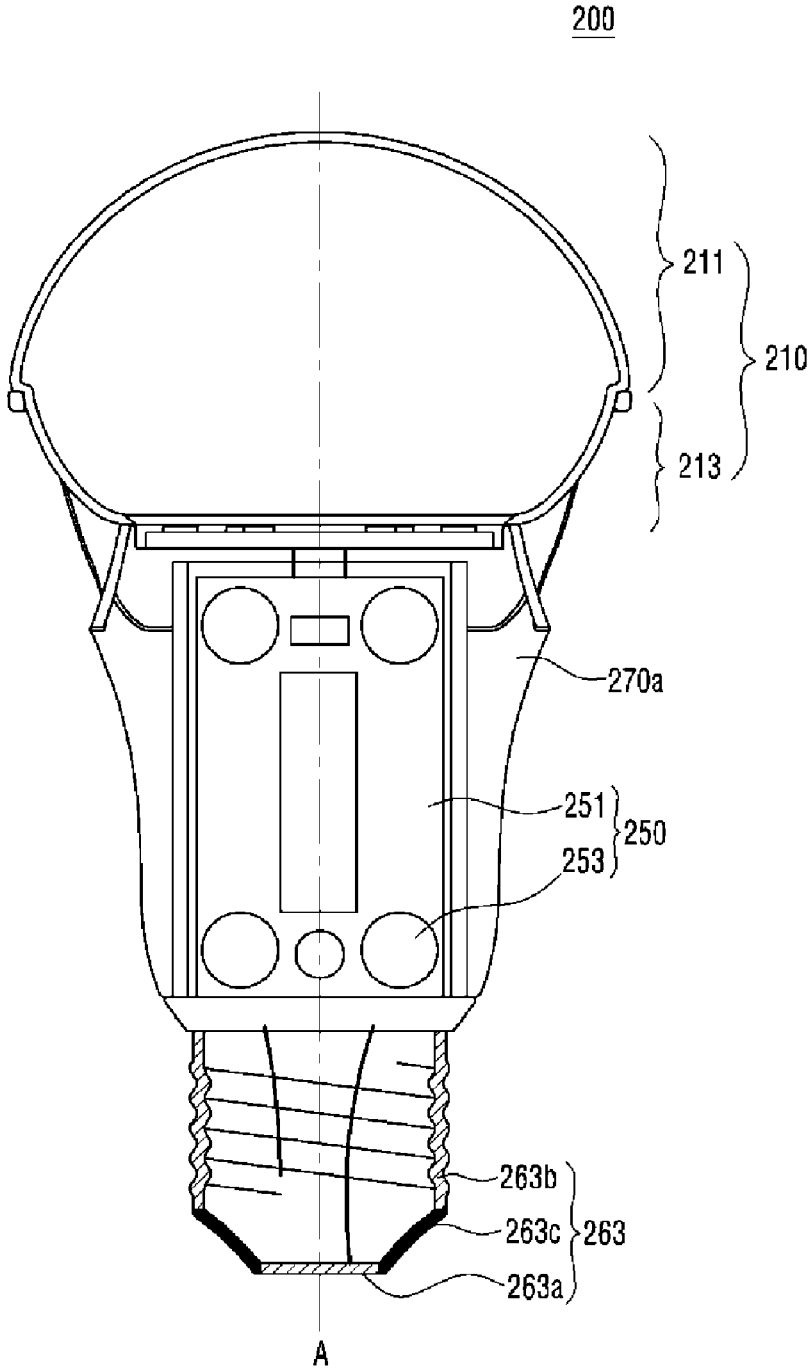
FIG. 30 is a cross sectional view of the lighting device 200 shown in FIG. 28.

FIG. 28 is a perspective view showing a lighting device 200 according to further another embodiment of the present invention. FIG. 29 is an exploded perspective view of the lighting device 200 shown in FIG. 28. FIG. 30 is a cross sectional view of the lighting device 200 shown in FIG. 28.

Referring to FIGS. 28 to 30, a lighting device 200 includes a cover 210, a light emitting module 230, a power controller 250, an inner case 260 and an outer case 270.

The cover 210 surrounds and protects the light emitting module 230. The cover 210 reflects and refracts light generated from the light emitting module 230 and distributes the light to the front or rear of the lighting device 200. The outer case 270 surrounds the power controller 250 and the inner case 260 and the like and determines the external appearance of the lighting device 200.

<Cover>

The cover 210 has a bulb shape. The cover 210 includes a sealed upper cover 211 and a lower cover 213 having an opening 'G1''.

The sealed upper cover 211 and the lower cover 213 are made of the same material, for example, glass. However, the glass is vulnerable to weight or external impact. Therefore, plastic, polypropylene (PP) and polyethylene (PE) and the like can be used. Here, polycarbonate (PC), etc., having excellent light resistance, excellent thermal resistance and excellent impact strength property can be also used as the material of the cover 210.

The inner surface of the cover 210 is coated with a yellowish pigment. The pigment may include a diffusing agent such that light passing through the cover 210 can be diffused throughout the inner surface of the cover 210.

<Light Emitting Module>

The light emitting module 230 includes a substrate 231 and a plurality of light emitting devices 233 mounted on the substrate 231.

The substrate 231 has a circular shape and is seated in the opening 'G1'' of the lower cover 213. The substrate 231 is made by printing circuit patterns on an insulator and includes, for example, a common printed circuit board (PCB), a metal core PCB, a flexible PCB and a ceramic PCB and the like. The substrate 231 includes a chips on board (COB) allowing an unpackaged LED chip to be directly bonded thereon. Further, the substrate 231 can be made of a material capable of efficiently reflecting light, or the surface of the substrate 231 may have color capable of efficiently reflecting light, for example, white and silver and the like.

The plurality of the light emitting devices 233 are radially arranged on the substrate 231, so that heat generated from the light emitting devices 233 can be efficiently radiated when the lighting device 200 is operated. Each of the plurality of the light emitting devices 233 includes at least one light emitting diode (LED). The LED may be a red, green, blue or white light emitting diode, each of which emits red, green, blue or white light respectively. The kind and number of the diodes are not limited to this.

Though not shown, a heat radiating plate (not shown) may be disposed in the rear of the light emitting module 230. The heat radiating plate is made of a thermal conduction silicon pad or a thermal conductive tape, which has a high thermal conductivity.

<Power Controller>

The power controller 250 includes a support plate 251 and a plurality of parts 253 mounted on the support plate 251. The plurality of the parts 253 includes, for example, a DC converter converting AC power supplied by an external power supply into DC power, a driving chip controlling the driving of the light emitting module 230, and an electrostatic discharge (ESD) protective device for protecting the light emitting module 230, and the like. However, there is no limit to the parts.

<Inner Case>

The inner case 260 includes an insertion portion 261 inserted into the outer case 270, and a connection terminal 263 electrically connected to an external power supply.

The inner case 260 is made of a material having excellent insulation and durability, for example, a resin material.

The insertion portion 261 has a cylindrical shape with an empty interior.

The insertion portion 261 is inserted into a receiving groove 270*a* of the outer case 270 and protects the power controller 250.

The connection terminal 263 is connected, for example, to an external power supply in the form of a socket. The connection terminal 263 includes a first electrode 263*a* at a lower apex thereof, a second electrode 263*b* on the lateral surface thereof, and an insulating member 263*c* between the first electrode 263*a* and the second electrode 263*b*. Electric power is supplied to the first electrode 263*a* and the second electrode 263*b* from an external power supply. Here, since the shape of the connection terminal 263 is variously changed according to the design of the lighting device 200, there is no limit to the shape of the connection terminal 263.

<Outer Case>

The outer case 270 is coupled to the inner case 260 and receives the light emitting module 230 and the power controller 250 and the like.

The outer case 270 includes a ring structure 271, a cone-shaped body 273 having a opening, and a connection portion 275 that physically connects the ring structure 271 with the body 273.

The body 273 has a cone shape. The connection portion 275 includes a plurality of ribs. An opening 'G3'' is formed among the plurality of the ribs.

The ring structure 271 surrounds the lower cover 213 and has a diameter larger than that of the body 273. The light emitting module 230 is seated in the opening 'G2'' of the body 273.

Such an outer case 270 is made of a material having excellent insulation and durability, for example, a resin material.

The structure of the aforementioned lighting device 200 allows the lighting device 200 to be substituted for a conventional incandescent bulb. Therefore, it is possible to use equipments for the conventional incandescent bulb without the use of a mechanical connection structure for a new lighting device or without the improvement of assembly.

Figure 31:
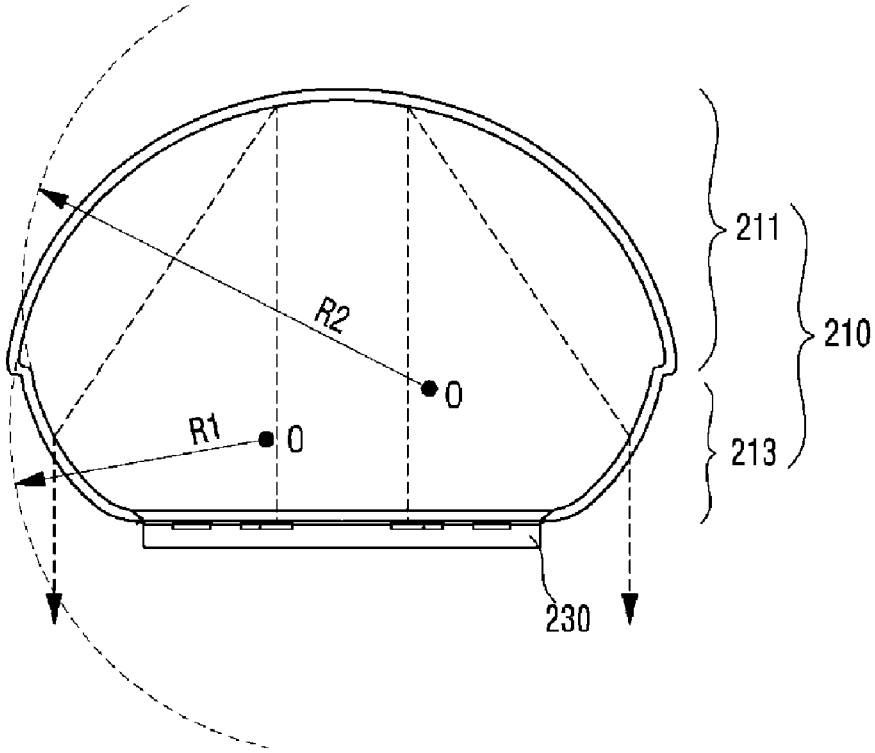
FIG. 31 is a cross sectional view for describing the structure of the cover 210 shown in FIG. 28 and the light distribution characteristic of the cover 210 shown in FIG. 28.

FIG. 31 is a cross sectional view for describing the structure of the cover 210 shown in FIG. 28 and the light distribution characteristic of the cover 210 shown in FIG. 28.

Referring to FIG. 31, the cover 210 includes the upper cover 211 and the lower cover 213. The lower cover 213 extends having a level difference from the upper cover 211.

The light generated from the light emitting module 230 is irradiated to the front of the cover 210 through the upper cover 211 and is irradiated to the rear of the cover 210 through the lower cover 213 after being reflected by the sealed upper cover 211. Such light has an influence on the front light distribution characteristic and the rear light distribution characteristic of the cover 210. Particularly, the rear light distribution characteristic of the cover 210 is changed according to the shape or structure of the lower cover 213.

In the cover 210, the curvature radius 'R2' of any curved surface of the lower cover 213 is constant. The curvature radius 'R2' of any curved surface of the lower cover 213 is larger than a curvature radius 'R1' of any curved surface of the upper cover 211. Accordingly, the light path in the lower cover 213 is extended to the rear, so that the rear light distribution characteristic can be improved.

Figure 32:
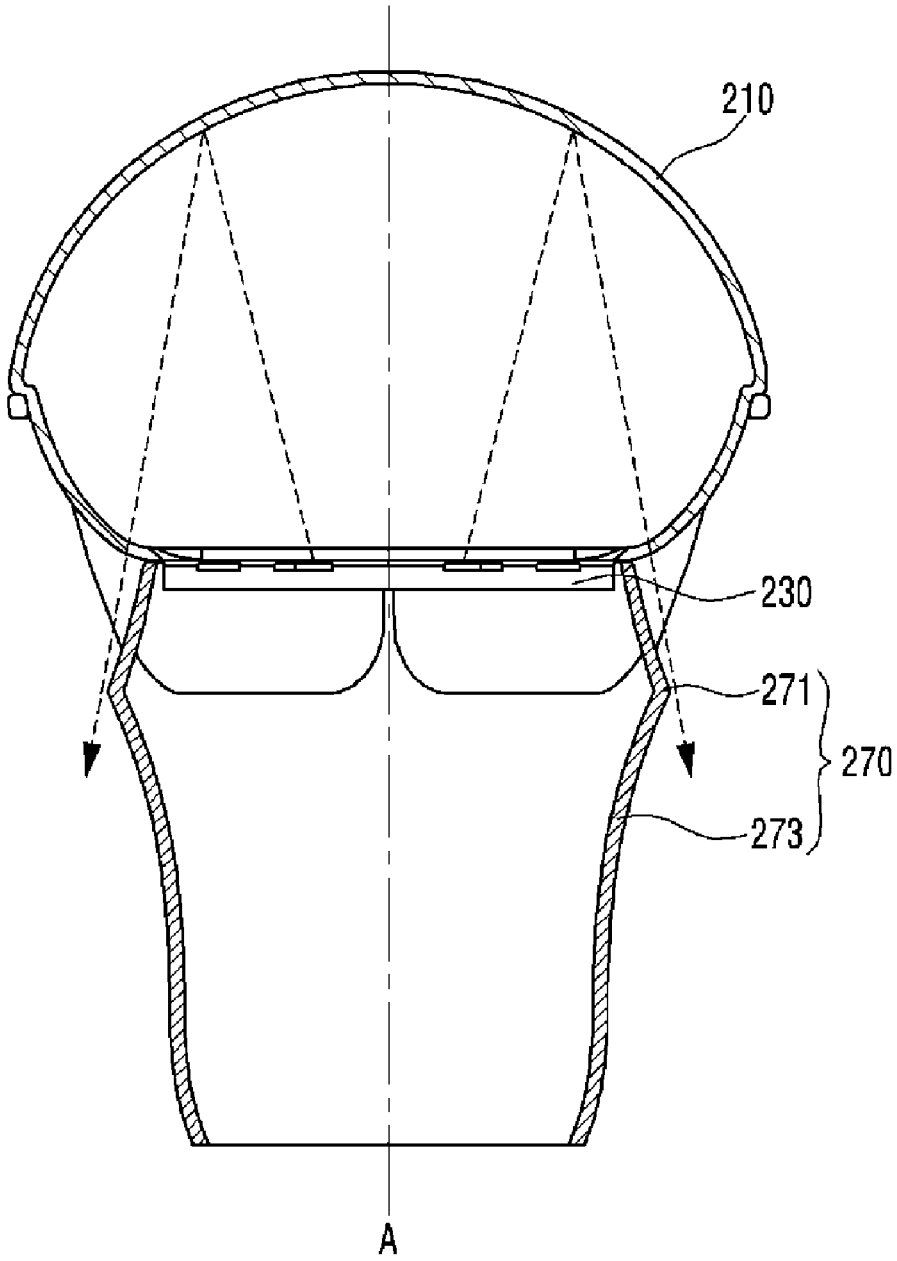
FIG. 32 is a cross sectional view for describing the rear light distribution characteristic based on the structures of the cover 210 shown in FIG. 28 and the outer case 270 shown in FIG. 28.

FIG. 32 is a cross sectional view for describing the rear light distribution characteristic based on the structures of the cover 210 shown in FIG. 28 and the outer case 270 shown in FIG. 28.

Referring to FIG. 32, light generated from the light emitting module 230 is irradiated to the rear of the cover 210 through the lower cover 213. In this case, when there is at least no obstruction to the path of the light irradiated to the rear of the cover 210, a sufficient light distribution characteristic can be obtained.

Accordingly, as shown in FIG. 32, the upper outer circumferential surface of the body 273 of the outer case 270 is inclined with respect to the central axis 'A' of the outer case 270. Accordingly, the light reflected by the cover 210 is irradiated to the rear of the cover 210 without any obstruction, so that the rear light distribution characteristic can be improved.

The features, structures and effects and the like described in the embodiments are included in at least one embodiment of the present invention and are not necessarily limited to one embodiment. Furthermore, the features, structures and effects and the like provided in each embodiment can be combined or modified in other embodiments by those skilled in the art to which the embodiments belong. Therefore, the contents related to the combination and modification should be construed to be included in the scope of the present invention.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A lighting device comprising:

a light emitting module including a substrate and a light emitting diode disposed on the substrate;

a member disposed on the light emitting module, the member including:

a base having a hole configured to receive the light emitting diode; and a projection configured to reflect light from the light emitting diode, a diameter of the base being greater than a maximum diameter of the projection;

a cover surrounding the light emitting module and the member; and a heat sink including:

an upper portion having a flat surface on which the substrate is disposed; and a lower portion having a plurality of grooves formed on a side surface of the lower portion of the heat sink, the upper portion of the heat sink having a first diameter of a portion adjacent to the flat surface and a second diameter of a portion adjacent to the lower portion, and the first diameter being less than the second diameter, and the lower portion of the heat sink having a third diameter of a portion adjacent to the upper portion and a fourth diameter of a portion away from the upper portion, and the third diameter being greater than the fourth diameter.

2. The lighting device of claim 1, further comprising a seating portion placed on the flat surface of the heat sink, wherein the seating portion includes at least one groove and wherein the substrate includes a protruding portion that is inserted into the groove of the seating portion.

3. The lighting device of claim 2, wherein the seating portion comprises a partial opening or wherein a portion of the outer circumference of the seating portion comprises at least one straight portion.

4. The lighting device of claim 1, wherein the flat surface of the heat sink comprises a groove, a hole, or a projection, and wherein the substrate comprises a corresponding groove, a corresponding hole, or a corresponding projection, of which is coupled to the groove, the hole, or the projection of the flat surface.

5. The lighting device of claim 1, wherein the lower portion has a receiving groove, wherein the cover is connected to the upper portion of the heat sink, and wherein the lighting device further comprises:

a power controller disposed in the receiving groove of the lower portion of the heat sink; and an inner case being received in the receiving groove of the lower portion of the heat sink and electrically insulating the power controller from the heat sink.

6. The lighting device of claim 5, wherein the inner case comprises:

an insertion portion including at least one groove and/or at least one protruding portion; and a connection terminal being coupled to the insertion portion and including at least one groove or at least one protruding portion, wherein the groove or the protruding portion of the insertion portion are disposed horizontally with respect to one side end of the insertion portion, and wherein the protruding portion of the insertion portion is inserted into the groove of the connection terminal, or the protruding portion of the connection terminal is inserted into the groove of the insertion portion.

7. The lighting device of claim 6, wherein the groove of the insertion portion comprises:

a first guide groove;

a second guide groove; and a locking projection, wherein the first guide groove is disposed perpendicularly to one side end of the inner case, wherein the second guide groove is disposed perpendicularly to the first guide groove, wherein the locking projection is disposed perpendicularly to the second guide groove, and wherein the protruding portion of the connection terminal is seated in the locking projection through the first guide groove and the second guide groove.

8. The lighting device of claim 1, further comprising an outer case coupled to the heat sink, wherein the outer case comprises a body coupled to the heat sink, a ring structure disposed separately from the body, and a connection portion connecting the ring structure with the body.

9. The lighting device of claim 1, wherein the cover comprises an opening, wherein the area of the opening is less than that of a reference surface passing through the center of the cover, wherein the area of the opening is greater than the area of the top surface of the projection of the member, and wherein the area of the top surface of the projection is less than that of the reference surface passing through the center of the cover.

10. The lighting device of claim 9, wherein the cover comprises an upper cover and a lower cover connected to the upper cover, and wherein a curvature radius of the lower cover is larger than that of the upper cover.

11. The lighting device of claim 1, wherein the member comprises a predetermined inclined surface disposed in an outer circumference of the base.

12. The lighting device of claim 11, wherein an end of the inclined surface of the member is placed on the same line with a bottom surface of the substrate.

13. The lighting device of claim 11, wherein the inclined surface comprises a first inclined surface and a second inclined surface, wherein the first inclined surface is connected to the outer circumference of the base and has a predetermined upward inclination, and wherein the second inclined surface is connected to the first inclined surface and has a predetermined downward inclination.

14. The lighting device of claim 13, wherein a straight-line distance from a central axis of the base to the light emitting diode is greater than a straight-line distance from the light emitting diode to an inner circumference of the first inclined surface.

15. The lighting device of claim 1, wherein the light emitting module further comprises another light emitting diode facing the light emitting diode with respect to a central axis of the substrate, and a distance between the two light emitting diodes is greater than a maximum diameter of the projection of the member.

16. The lighting device of claim 1, wherein a peak of the projection of the member is located higher than a light emitting surface of the light emitting diode.

17. The lighting device of claim 1, wherein the projection of the member has a hemisphere part or a cone.

18. The lighting device of claim 1, wherein the light emitting module further comprises one or more other light emitting diodes, and the light emitting diode and the one or more other light emitting diodes are radially arranged on the substrate around the projection of the member.

19. A lighting device comprising:

a light emitting module including a substrate and a light emitting diode disposed on the substrate;

a cover to which light generated from the light emitting diode is irradiated and including a partial opening; and a heat sink being coupled to the cover and configured to radiate heat generated from the light emitting diode, wherein the heat sink includes an upper portion of which a top surface is at least partly flat and a lower portion having heat radiating fins formed therein, wherein the upper portion of the heat sink includes a groove, a hole, or a projection, wherein the substrate of the light emitting module is coupled to the groove, the hole, or the projection of the upper portion of the heat sink, wherein the heat sink includes a guide disposed on the top surface of the heat sink, wherein the guide of heat sink includes a straight portion, and wherein the substrate of the light emitting module includes a straight portion coupled to the straight portion of the guide of heat sink such that the light emitting module is arranged on the top surface of the heat sink in a certain direction.

* * * * *

UNITED STATES PATENT AND TRADEMARK OFFICE

CERTIFICATE OF CORRECTION

PATENT NO. : 8,227,964 B2
APPLICATION NO. : 13/153156
DATED : July 24, 2012
INVENTOR(S) : Tae Young Choi et al.

It is certified that error appears in the above-identified patent and that said Letters Patent is hereby corrected as shown below:

Title Page, Item (30) should read:

-- (30) Foreign Application Priority Data

Jun. 4, 2010 (KR) ..... 10-2010-0053089
Jul. 13, 2010 (KR) ..... 10-2010-0067617
Sep. 16, 2010 (KR) ..... 10-2010-0090987
Sep. 16, 2010 (KR) ..... 10-2010-0090989
Sep. 16, 2010 (KR) ..... 10-2010-0090990 --

Signed and Sealed this
Eleventh Day of September, 2012

David J. Kappos

David J. Kappos
*Director of the United States Patent and Trademark Office*